US006604816B1

(12) United States Patent
Yonekura et al.

(10) Patent No.: US 6,604,816 B1
(45) Date of Patent: Aug. 12, 2003

(54) INK-JET RECORDING HEAD AND INK-JET RECORDER

(75) Inventors: Seiji Yonekura, Hitachi (JP); Yoshinobu Fukano, Hitachi (JP); Mamoru Okano, Hitachi (JP); Tatsuo Igawa, Kitaibaraki (JP); Kazuhito Masuda, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/019,266

(22) PCT Filed: Jun. 12, 2000

(86) PCT No.: PCT/JP00/03802

§ 371 (c)(1),
(2), (4) Date: Dec. 28, 2001

(87) PCT Pub. No.: WO01/00415

PCT Pub. Date: Jan. 4, 2001

(30) Foreign Application Priority Data

Jun. 30, 1999 (JP) ..... 11-184774

(51) Int. Cl.[7] ..... B41J 2/16; B41J 2/045
(52) U.S. Cl. ..... 347/54; 347/68
(58) Field of Search ..... 347/54, 55, 20, 347/40, 43, 100, 68–72, 56–62

(56) References Cited

U.S. PATENT DOCUMENTS

| | | | | |
|---|---|---|---|---|
| 5,777,644 A | * | 7/1998 | Yamaguchi et al. | 347/68 |
| 6,158,844 A | * | 12/2000 | Murakami et al. | 347/55 |
| 6,220,696 B1 | * | 4/2001 | Suetsugu et al. | 347/55 |

FOREIGN PATENT DOCUMENTS

| | | | |
|---|---|---|---|
| EP | 0 882 591 | 12/1998 | B41J/2/06 |
| JP | 7-502218 | 3/1995 | B41J/2/06 |
| JP | 10-21745 | 8/1998 | B41J/2/06 |
| JP | 10-337872 | 12/1998 | B41J/2/06 |
| JP | 11-34338 | 2/1999 | B41J/2/06 |
| JP | 11-157081 | 6/1999 | B41J/2/06 |
| JP | 11-348292 | 12/1999 | B41J/2/06 |
| JP | 2000-6419 | 1/2000 | B41J/2/06 |
| WO | 93/11866 | 6/1993 | B01J/2/06 |

OTHER PUBLICATIONS

Patent Abstracts of Japan 11–034338 Feb. 9, 1999.
Patent Abstracts of Japan 11–157081 Jun. 15, 1999.
Patent Abstracts of Japan 10–337872 Dec. 22, 1998.
Patent Abstracts of Japan 10–217475 Aug. 18, 1998.
Patent Abstracts of Japan 11–348292 Dec. 21, 1999.
Patent Abstracts of Japan 2000–006419 Jan. 11, 2000.

* cited by examiner

*Primary Examiner*—John Barlow
*Assistant Examiner*—An H. Do
(74) *Attorney, Agent, or Firm*—Antonelli, Terry, Stout & Kraus, LLP

(57) ABSTRACT

The recording electrodes and the control electrodes of an ink jet recording head are alternately arranged on a substrate. Ink in which coloring material is distributed in a solvent is supplied to the recording electrode so that the ink can flow in the direction of the length of the recording electrode. An ink circulation part is provided for collecting surplus ink from the point of the recording electrode from which ink is discharged. As a result, an ink jet recorder, which can produce a high definition image without shifting the ink impact position on the recording medium, can be produced.

32 Claims, 16 Drawing Sheets

INK-JET RECORDING HEAD AND INK-JET RECORDER

TECHNICAL FIELD

The present invention relates to an ink jet recording head and an ink jet recorder of the type used to print an image by discharging ink drops from an electrode of the recording head and propelling them onto a recording medium.

BACKGROUND OF THE INVENTION

An ink jet recorder discharges ink droplets from a discharge opening and guides them onto a recording medium. The dots are formed by leading ink from an ink tank to each discharge opening and applying kinetic energy to the ink, so that a small amount of ink in the form of a drop is discharged from a minute discharge opening, the ink drop is projected onto a recording medium, and an image is printed.

There is a method (electrostatic recording) of discharging ink by use of an electrostatic force, in which a voltage is applied between a common electrode, which is placed in contact with the recording medium, and a recording electrode, and this is one of the driving methods by which kinetic energy is applied to the ink. This method is recognized as a way to achieve high definition in an ink jet printer, because the amount of ink discharged on recording medium can be controlled by pulse-width-modulating the voltage applied to the recording electrode.

An example of such a method is disclosed in the Patent Application Laid-open No.7-502218 (PCT), in which ink, in which a coloring material is dissolved in a solvent in a low concentration, is supplied to the surface of the recording electrode, an electric field is formed by applying a voltage to the recording electrode, the coloring material subjected to the electric charge is agglutinated, and the agglutinated coloring material is discharged from the recording electrode on a path toward the recording medium. Further, the technology concerning the structure of the recording head in a recording method similar to the above-mentioned example is described in the Japanese Patent Application Laid-Open No. 11-34338.

SUMMARY OF THE INVENTION

An image is recorded by discharging agglutinated coloring material onto a recording medium by applying an electrical bias to the recording electrode, while making the ink circulate, collecting the ink in which the coloring material is agglutinated on the point of the recording electrode, and superimposing a pulse voltage on the electrical bias of the recording electrode in this state, thereby effecting electrostatic recording as disclosed in the above-mentioned official report.

Further, clogging of the ink is not generated easily in general in electrostatic recording because a small hole does not exist in the ink discharge part. Therefore, even if the recording head is manufactured in the form of a line head, a defective portion where discharge is not performed is not generated easily. Therefore, an ink jet recorder which has a line head can be achieved. There is a feature that it is possible to print at high speed because the record recorder with a line head can record on the recording medium at the same time in the omnidirection of width. However, because it is necessary to discharge the coloring material agglutinated at the point of the recording electrode in the method disclosed in the above-mentioned official report, it is necessary to supply a large amount of coloring material to print at high speed using high-speed ink circulation. Further, there is a limitation in making ink circulate at high speed in the flight channel (Hereafter simply called the channel) formed by micro-fabrication. Further, it is necessary to manufacture a lot of channels without a defect to achieve a line head. Further, it is necessary to have the same print characteristic in the press by all channels. Therefore, it becomes important to arrange the shape of a lot of the channels when a line head is manufactured, and to manufacture it cheaply and easily.

Further, when the interval of the recording electrode narrows, the discharge is influenced easily by the electric field generated by the voltage applied to the adjacent recording electrode in this recording method. There is also the displacement of the impact position of the discharge as a problem which occurs due to the influence of this electric field. The cause of this problem will be explained as follows.

The voltage applied to recording electrodes A and B, when a discharge is to be produced from the recording electrodes A and B and is not to be produced from an electrode C among three recording electrodes A, B, and C, increases more than the voltage applied to recording electrode C. Therefore, the component of the electric field directed to the recording electrode C is generated in the electric field in the vicinity of the point of recording electrode B. Therefore, the discharge produced from recording electrode B is impacted so as to approach the position on the recording medium where recoding is to be effected by recording electrode C. As a result, a problem of distortion of the image on the recording medium and a deterioration of the picture quality occurs. To prevent the potential applied to a recording electrode from being transferred to an adjacent recording electrode through the ink, the ink is divided into parts in each channel by providing a member for partitioning ink between recording electrodes arranged in a line. Therefore, not enough effect is achieved, though the displacement of the impact position of the discharge is reduced. Because the configuration disclosed in Patent Application Laid-Open No. 7-502218 (PCT) does not have a partition between recording electrodes arranged in a line, the displacement of the impact position of the discharge increases easily, when printing.

Further, each channel is divided by a partition, and the recording electrode is arranged at the position which comes in contact with ink which flows in the channel in the configuration disclosed the above-mentioned Japanese Patent Application Laid-Open No. 11-34338. Therefore, not enough effect is achieved, though the displacement of the impact position of the discharge is reduced.

Further, the recording head described in the above-mentioned official report has a relief structure formed from the ink channel bottom and the wall which partitions each ink channel. Therefore, costs of manufacture are high because the relief structure needs to be manufactured by using either a method of bonding with accumulating a concave part and a convex part or a method of cutting down the concave part using a dicer, etc.

Further, the recording head described in the above-mentioned official report does not have means to optimize the curve profile of the liquid level of ink (hereafter called an ink meniscus) due to the surface tension of the ink generated on the point of said recording electrode, which influences the concentration of the electric field on the point of the recording electrode of each channel. Because the concentration of the electric field on the point of the recording electrode is weak, it is necessary to raise the voltage applied to the recording electrode for effecting a discharge. As a result, the driving circuit for applying the voltage becomes expensive and the amount of flight of the discharge does not becomes uniform.

The present invention is directed toward solving the above-mentioned problems.

An object of the present invention is to provide an ink jet recording head which can prevent the impact position of the discharge from shifting and obtain a high definition image.

Another object of the present invention is to provide an ink jet recording head in which the shape of a lot of channels can be easily made uniform when line heads are manufactured, and which can be manufactured cheaply and easily.

Another object of the present invention is to provide an ink jet recording head which can be driven at a low voltage and in which the amount of discharge of ink can be made uniform.

Another object of the present invention is to provide an ink jet recording head which can print at high speed.

In accordance with the present invention, an ink jet recording head has a substrate, a plurality of recording electrodes arranged on said substrate, a plurality of control electrodes arranged so as to sandwich each of said recording electrodes, and an ink circulation part for supplying ink, which contains coloring material in a solvent, to said recording electrodes, to cause it to flow in a direction of the length of said recording electrode, and for collecting said ink from the point of said recording electrode.

The electric potential applied to the recording electrode of the channel from which ink is discharged is prevented from being shifted to a surrounding channel by individually providing ink channel for every channel through which ink passes. As a result, the electric field distribution around the recording electrode in the channel from which ink is discharged is stabilized, and the direction of ink discharge is stabilized. Further, the electric field distribution at the point of the recording electrode from which ink is discharged is stabilized and the direction of the ink discharge is stabilized by setting up control electrodes so as to sandwich the recording electrode and by applying constant potential to the control electrodes.

Further, an electrical discharge due to the electric breakdown of air is prevented by applying a protection film on the recording electrode.

Further, the ambient air along with ink from the recording electrode to ink collection channel is collected. The ink meniscus form is controlled by the collected air flow, and a low voltage drive and a uniform ink flight amount are made possible.

Further, the ratio of the insoluble material, such as the coloring material contained in the discharged ink is made lower than the ratio of the solvent, and printing speed is increased.

BEST MODE FOR IMPLEMENTING THE INVENTION

Figure 4:
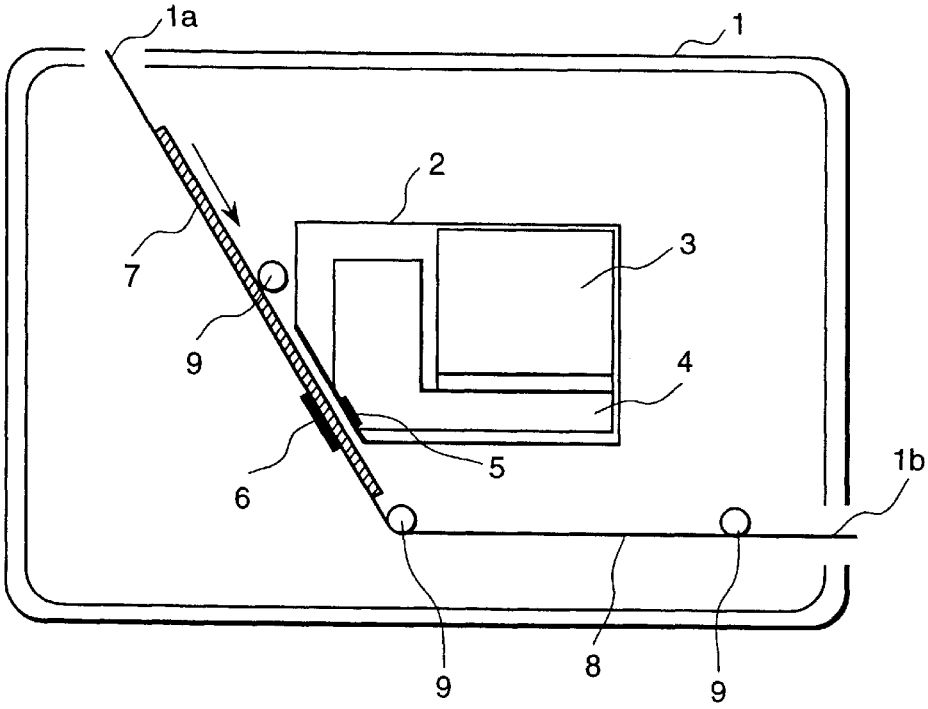
FIG. 4 is a sectional view of an ink jet recorder according to the present invention.

FIG. 4 shows one embodiment of an ink jet recorder according to the present invention. The ink jet recorder has a housing 1, a recording head 2, an ink tank 3 for replenishment, an ink circulation part 4, ink part 5, a common electrode 6, a recording medium 7 and a recording medium carrying passage 8. A grounded common electrode 6, a recording head 2 arranged so that the ink discharge entrance is directed to said common electrode 6, a recording medium carrier device for passing recording medium 7 between common electrode 6 and recording head 2, a settling device for settling ink printed on the recording medium, and a controller for controlling the entire recorder device are provided in the housing 1 of the ink jet recorder. Ink discharge part 5, a pulse voltage generation circuit for applying a pulse voltage for ink discharge to the ink discharge part, and an ink jet recording head which contains ink circulation part 4 are integrated with each other.

Details of each part are as follows. Ink discharge part 5 arranged in a row in a direction extending across the recording medium carrying passage, ink tank 3 for storing ink, ink circulation part 4 for supplying ink to the ink discharge part 5, a power supply for generating a record pulse-width modulated voltage according to a picture signal from the controller, and a bias supply (not shown) are accommodated in the recording head 2.

Recording head 2 for each of the cyan, magenta, yellow, and black colors is at least arranged in the ink jet recorder which is able to print in color, although the recording head for one color has been shown in FIG. 4.

The recording medium carrier device comprises recording medium carrying passage 8, which is provided from recording medium insertion entrance 1*a* to recording medium outlet 1*b* through the recording position, a pick roller (not shown) which guides the recording medium 7 from the recording medium insertion entrance 1*a* to the recording medium carrying passage 8, a plurality of rollers 9 which come in contact with both sides of the surface of the recording medium in the carrying passage with a fixed pressure, and a motor (not shown) etc. which rotates each roller according to instruction from the controller which controls the entire device.

For instance, ink formed by using a solvent of the petroleum oil group, such as isoparafin of about 10 mPa·s with a low viscosity, or a solvent of silicon group, distributing the coloring material, for instance, pigments in said solvent with a dispersing agent and an electrification control agent, etc., and making the electrified coloring material particle can be stored in ink tank 3. Preferably, the electrical resistivity of said ink is $10^7$ Ω·cm or more, the surface tension is 30 mN/m or less, and the particle diameter of the coloring material is between 50 nm and 500 nm. Further, the surface charge density of the coloring material particle is preferably between 1 $\mu C/m^2$ and 100 $\mu C/m^2$, and the content of the coloring material particle is between 1 percent by weight and 10 percent by weight.

The method of circulating ink and the configuration of the ink discharge portion 5 will be described later in more detail.

First of all, ink circulation part 4 will be explained.

Figure 5:
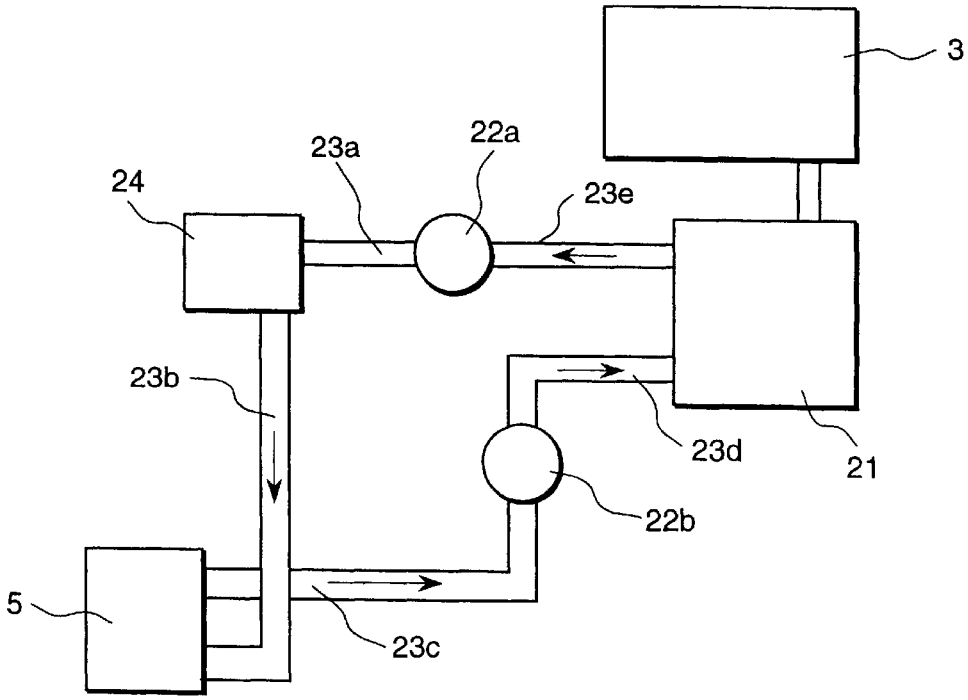
FIG. 5 is a schematic diagram showing the configuration of an ink jet recording head according to the present invention.

FIG. 5 shows an ink jet recording head, including the configuration of the ink circulation portion 4. Ink circulation portion 4 comprises ink holder 21 for holding ink to be circulated, ink flow modulating compartment 24 for adjusting ink flow supplied to the ink discharge portion 5, piping 23*a*, 23*b*,23*c*, 23*d*, 23*e* for connecting each of these parts, and pumps 22*a*, 22*b* driven according to control provided by the controller.

Ink circulation portion 4 configured in this way is divided into two systems, that is, an ink distribution system to supply ink to ink discharge portion 5, and an ink collection system to collect ink from the ink discharge portion 5.

Figure 6:
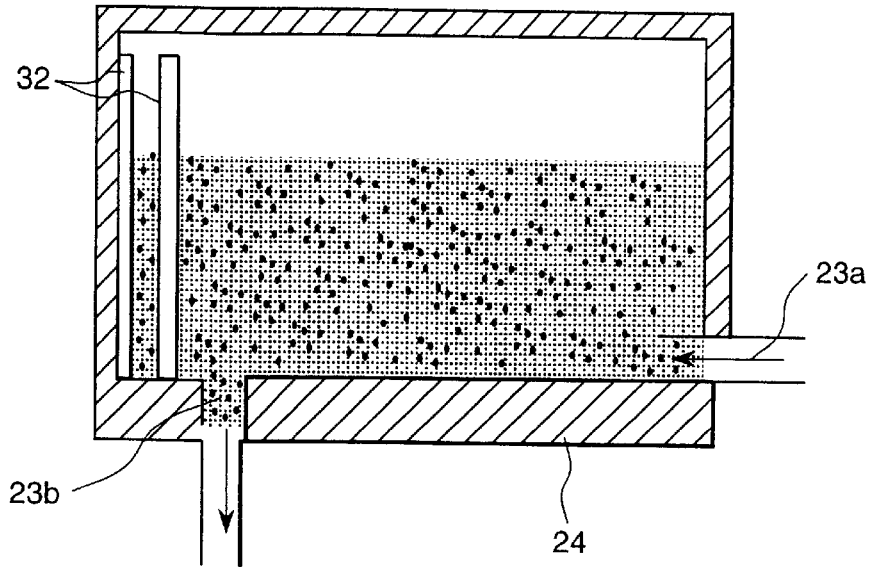
FIG. 6 is a diagram illustrating the method of adjusting ink pressure in the ink circulation system shown in FIG. 5.

In the ink distribution system, ink stored in the ink holder 21 is sucked up with a pump 22*a* and is sent to ink flow modulating compartment 24. Ink stored in the ink flow modulating compartment 24 flows naturally toward ink discharge portion 5, where the discharge electrode lines up, because of the pressure due to the potential energy determined by the liquid level difference between the liquid level of ink in the compartment 24 and that of the ink discharge portion 5. To prevent the liquid level of ink from changing in the ink modulating flow compartment 24, an ink liquid level detector 32 for detecting the liquid level of the ink is provided in ink flow modulating compartment 24, as shown in FIG. 6. This detection value is fed back to the controller. Therefore, pump 22*a* is driven so that the deviation between the detected value provided by the ink liquid level detector 32 and a set value becomes small, so that the amount of ink in the ink flow modulating compartment 24 is kept almost constant.

On the other hand, ink which has passed through ink discharge part 5 is sucked up by the with pump 22*b* and collected in the ink holder 21 of the ink collection system. Printing by this ink jet recorder is executed after these ink circulations become stable.

The ink circulation portion 4 shown here is one example, and another configuration in which ink of a proper amount can be supplied to and collected from ink discharge part can be adopted.

The configuration of ink discharge portion 5 will be described next.

Figure 1A:
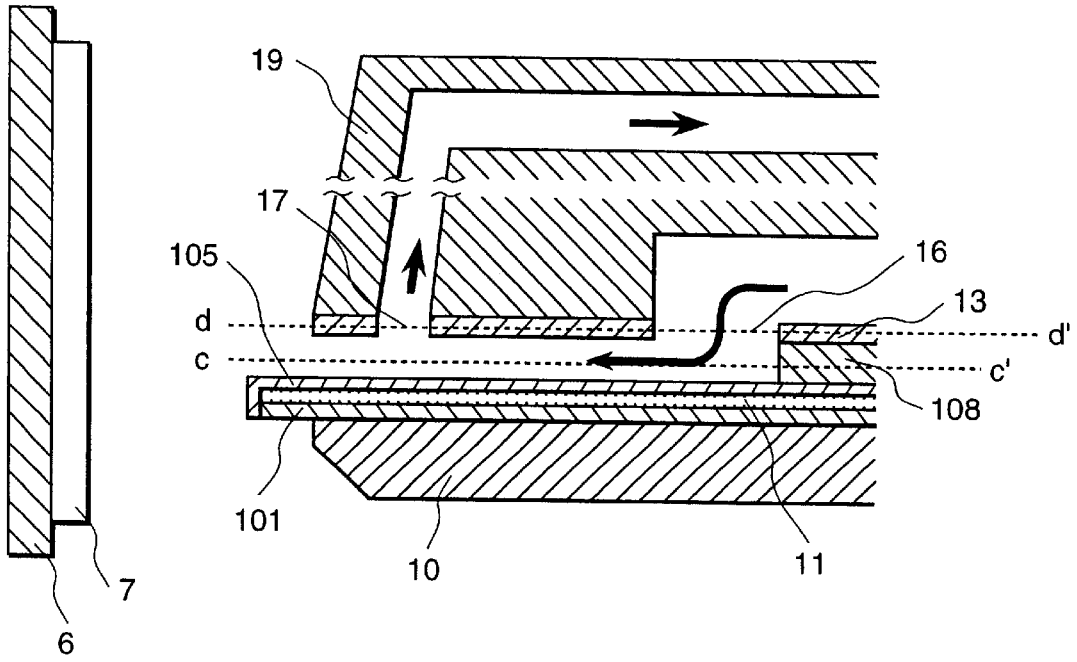
FIGS. 1(*a*) and 1(*b*) are sectional views of an ink discharge portion of an ink jet recording head according to the present invention, taken along lines a–a' and b–b', respectively, in FIG. 2.
Figure 1B:
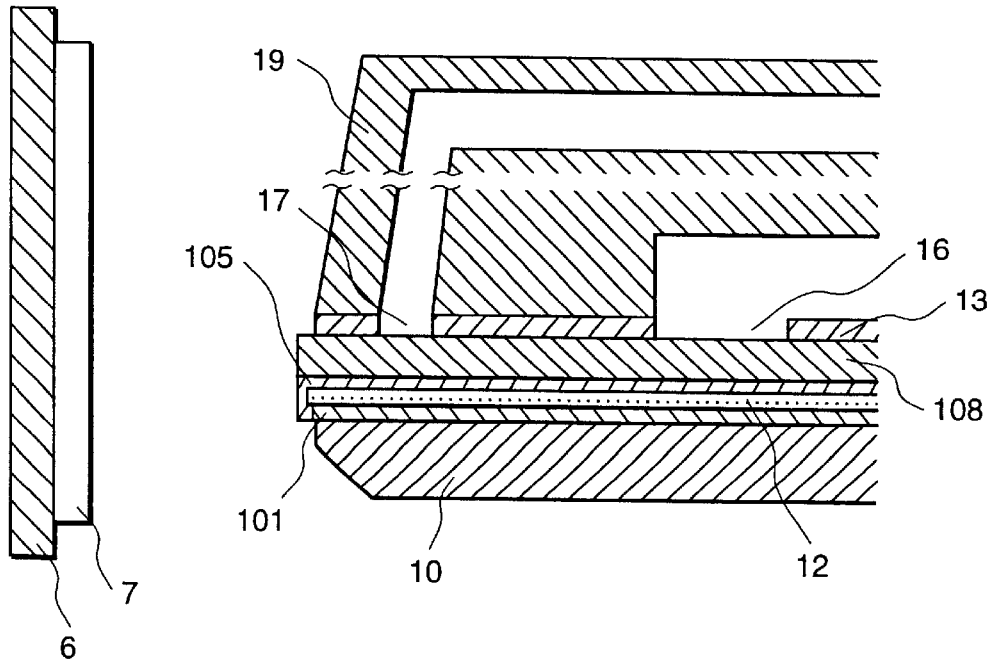
Figure 2:
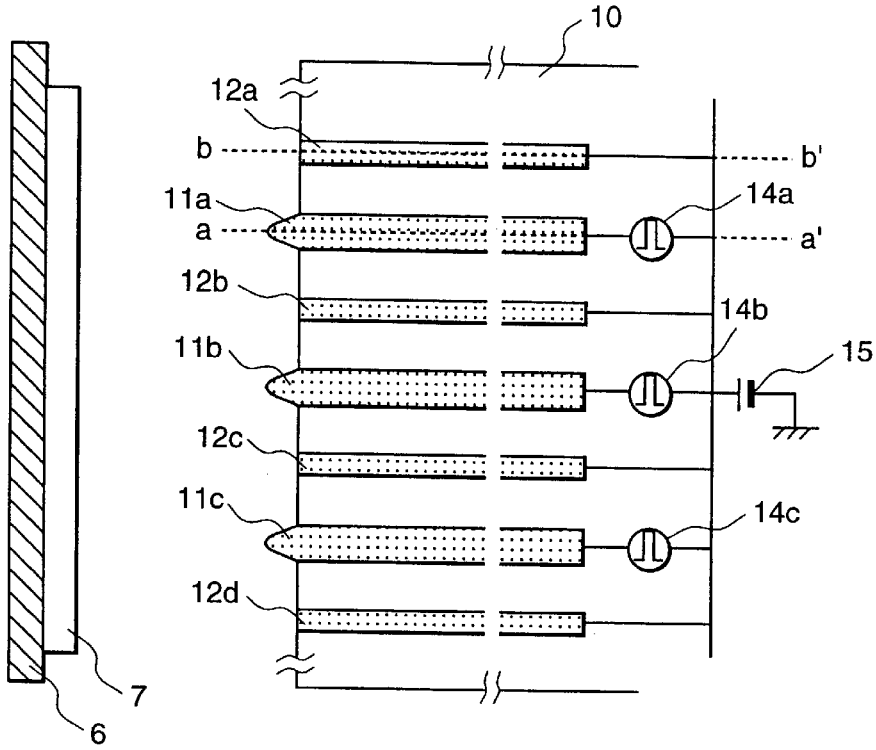
FIG. 2 is a sectional view taken along the line c–c' in FIG. 1.

FIGS. 1(*a*), 1(*b*) and FIG. 2 show the configuration of the periphery of ink discharge portion 5 used in the ink jet recorder of the present invention. Next, the state in the section (a–a' section) of recording electrode 11 and the section (b–b' section) of control electrode 12 in the ink discharge portion 5 shown in FIG. 2 are shown in FIG. 1.

FIG. 1(*a*) shows a section of the recording electrode 11 as seen along line a–a' in FIG. 2. Recording electrode 11, which has a convex part at its point, and control electrodes 12, which are arranged so as to sandwich the recording electrodes 11, are arranged on a substrate 10 made of an insulator, such as a glass, with a low permittivity, and the recording electrodes 11 are disposed at a fixed interval in a direction which extends across the recording medium carrying passage 8 and are arranged with the points thereof directed toward the common electrode 6.

The width of recording electrode 11 is about 80–150 $\mu$m, and the point of recording electrode 11 projects from the edge of substrate 10 toward common electrode 6 by about 100–200 $\mu$m. When the width of the recording electrode 11 is too narrow, the channel resistance increases and the ink does not flow easily. On the contrary, when the width of recording electrode 11 is too narrow, the amount of ink that flows increases and the ink does not collect easily. As a result, ink may leak into the recorder. Further, when the magnitude of the projection of the recording electrode 11 is too small, the amount of ink carried to the point of the recording electrode 11 increases too much, and the amount of the ink flight from the recording electrode 11 is not steady. On the other hand, the amount of ink carried to the point of the recording electrode 11 decreases and the ink does not fly when the amount of the projection of the recording electrode 11 is too large.

A constant voltage is always applied to control electrode 12 (its width is about 20–50 μm). As a result, the electric field distribution at the point of recording electrode 11 is proper at the time of ink discharge, and the impact position of ink is prevented from shifting. The point of the control electrode should project slightly beyond the edge of the substrate 10. The electric field at the point of control electrode 12 is eased when the point of control electrode 12 does not project from the substrate 10, and thus the installation effect becomes small.

Next, the method of applying a voltage to recording electrode 11 and control electrode 12 will be explained. An electrode bias of about 1.5–2 kV is usually applied to each recording electrode 11 in the ink discharge portion 5 of the recording head 2 by bias supply 15. In addition, a pulse voltage of about 0.5 kV is superimposed on the electrode bias by pulse voltage generation circuit 14 according to the record signal, and the resultant voltage is applied to this recording electrode. Coloring material electrified positively in the ink which circulates in the ink circulation system is collected at the point of the recording electrode 11 due to application of the electrode bias to the recording electrode 11. When the pulse voltage is applied, an ink drop is discharged from the point of the recording electrode 11. The ink drop is discharged from the point of the recording electrode by the electrostatic attraction force generated by the electric field formed between point 11-1 of the recording electrode and common electrode 6 acting on the ink on point 11-1 of said recording electrode, which electrostatic attraction force is sufficient to overcome the surface tension of the ink. Therefore, the discharged ink drop is configured of an insoluble material which contains an ink solvent and a coloring material. The weight ratio of the coloring material included in the ink drop increases more than that of the ink which circulates around other ink circulation parts because the above-mentioned coloring material is collected on the point of the recording electrode. The amount of insoluble material containing the coloring material component in the ink, which decreases due to said ink drops being discharged on the recording medium, is replenished from ink tank 3. The concentration of the insoluble material in the ink stored in ink tank 3 is higher than that in the ink which flows in the ink circulation part. This ink is properly replenished based on the result of detection of the concentration in the ink circulation part or the result of counting the number of print dots.

The voltage in the vicinity of the electrode bias is always applied to control electrode 12. As a result, the electric field distribution at the point of the recording electrode 11 is stabilized, and the impact position of ink on the recording medium is prevented from shifting when printing.

Figure 3:
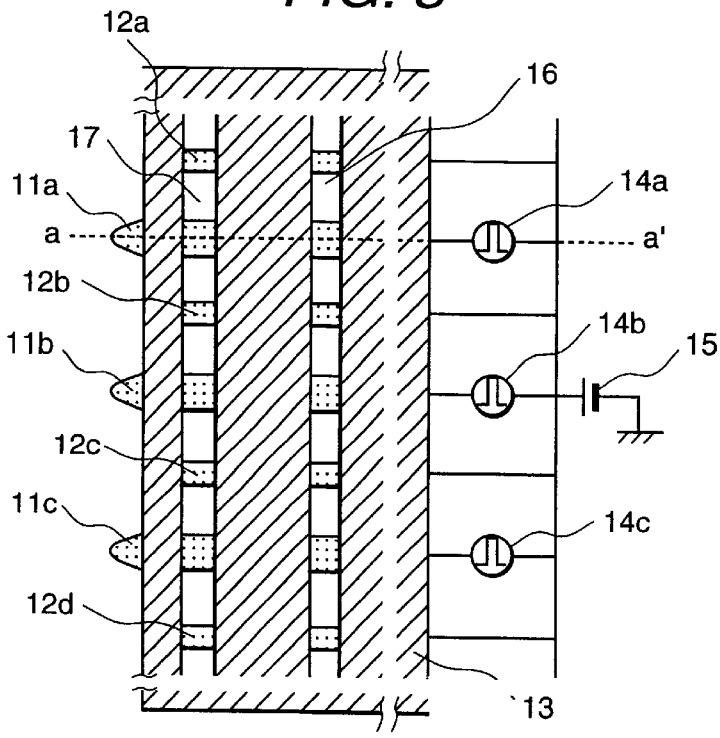
FIG. 3 is a sectional view taken along the line d–d' in FIG. 1.

Recording electrode 11 expands from voltage supply part (not shown), in the root in FIG. 1(*a*), and forms one of the walls of the ink channel with shroud 108 and upside insulating member 13. Ink is supplied from entrance 16, as indicated by the arrow, and it is collected from exit 17. The shape of the entrance 16 and the exit 17 is like a slit, as shown in the d–d' section (FIG. 3).

The point of recording electrode 11 projects from the edge of the substrate 10 toward common electrode 6, as explained with reference to FIG. 2. Here, because ink is supplied to the recording electrode 11, the metal layer of about 1 μm thick is provided on dielectric substance 101, which is about 20 μm thick, to give strength which can resist the weight of ink, and the voltage is applied to this. Further, recording electrode 11 is covered by a coating material, such as insulation protection films 105. The electric discharge occurs easily from the recording electrode 11 when the amount of ink supply to the point of the recording electrode 11 decreases for some reason. Therefore, this protection film is provided to prevent breakage of the point of the recording electrode 11 by the electrical discharge.

Figure 12:
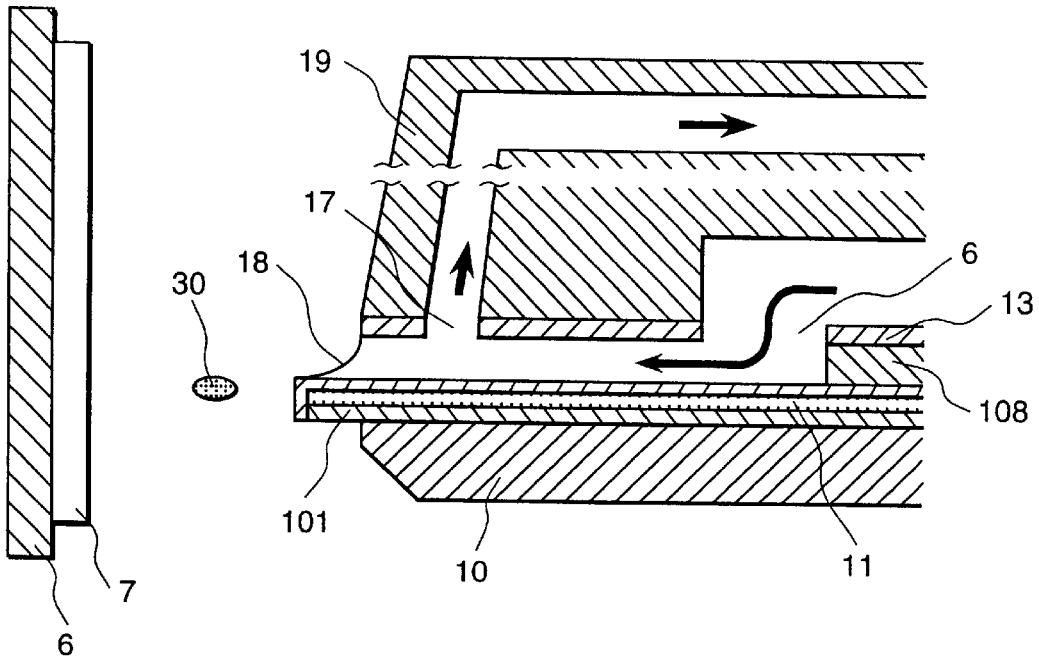
FIG. 12 is a sectional view showing an ink meniscus formed near the recording electrode in the ink discharge portion.
Figure 13:
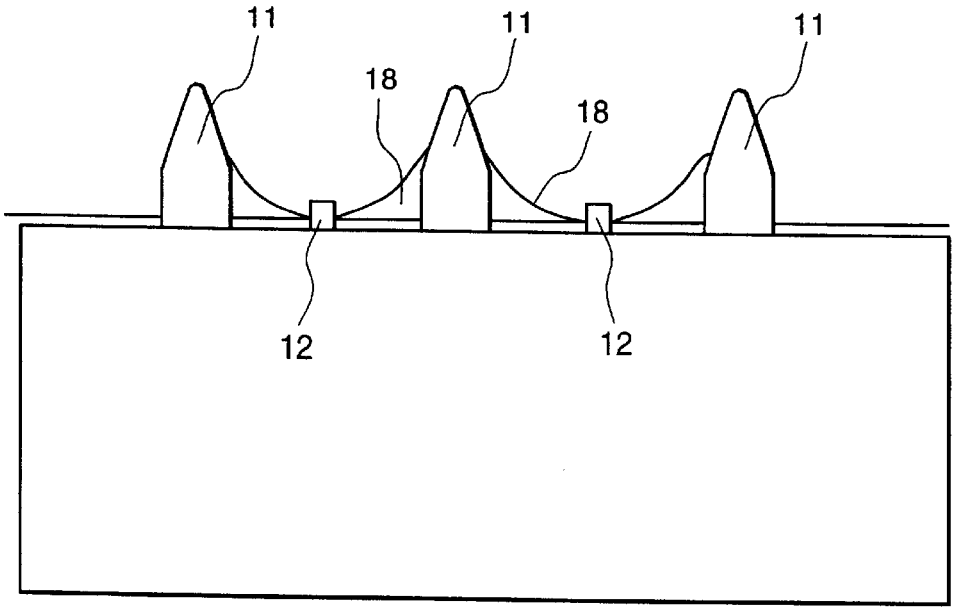
FIG. 13 is a diagram showing the ink meniscus formed near the recording electrode in the ink discharge portion.

When the ink is supplied or is collected as above-mentioned, an ink meniscus is formed in the vicinity of the point of recording electrode 11. FIG. 12 shows the state in which the ink meniscus is formed in the same section as FIG. 1. Further, FIG. 13 shows the ink meniscus as seen from the upper direction of the ink discharge part. The ink meniscus 18 is formed in a shape by which ink is supplied to the point of the recording electrode. When the pulse voltage is superimposed on the electrode bias at the time of recording, ink drop 30 in an amount corresponding to the applied time of the pulse voltage is discharged toward recording medium 7. When the weight ratio of the insoluble material which contains pigments included in said ink drop is more than the weight ratio of the solvent, a stable discharge of the ink drop becomes difficult as the applied period of the pulse voltage is increased from about 1 kHz to about 10 kHz. Therefore, it is preferable that the weight ratio of said insoluble material included in the ink drop is lower than that of the solvent.

Figure 7:
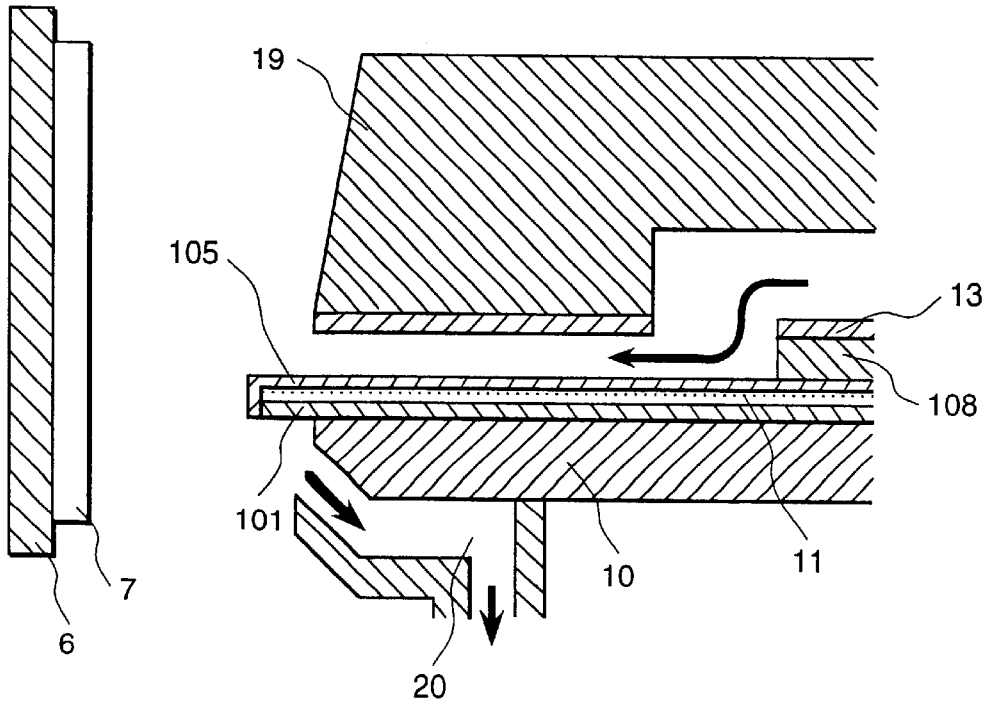
FIG. 7 is a sectional view showing the configuration, besides the ink discharge portion of FIG. 1, of the ink jet recording head according to the present invention.
Figure 8A:
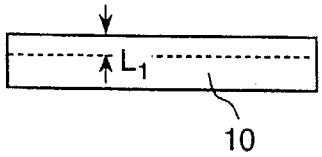
FIGS. 8(*a*) to 8(*e*) are section views which illustrate successive steps in one example of the method of manufacturing the ink discharge portion according to the present invention, and FIGS. 8(*a*)(1) to 8(*e*)(1) are top plan views of the structures illustrated in FIGS. 8(*a*) to 8(*e*), respectively.
Figure 8A:
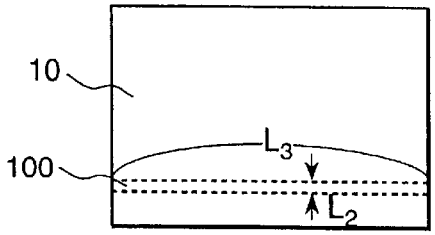
Figure 8B:
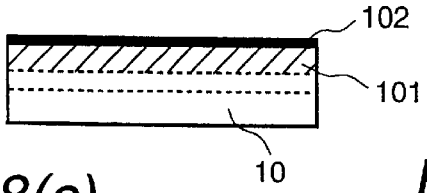
Figure 8B:
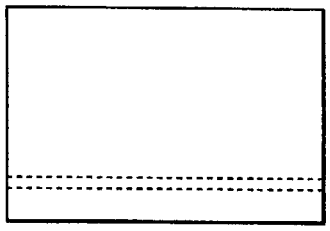
Figure 8C:
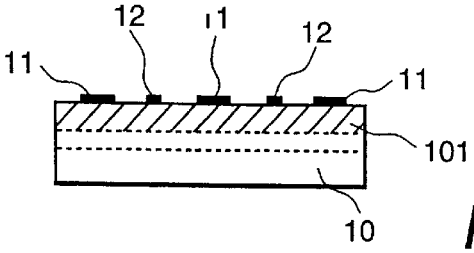
Figure 8C:
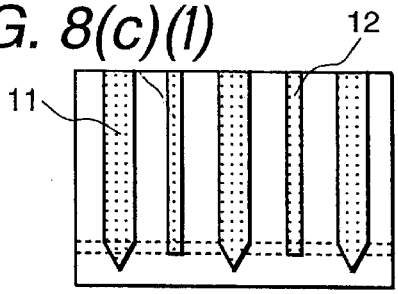
Figure 8D:
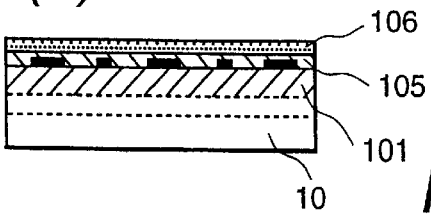
Figure 8D:
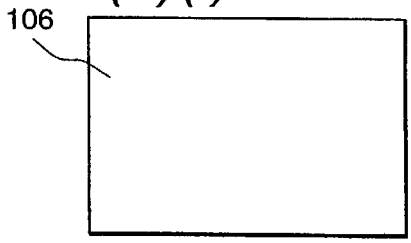
Figure 8E:
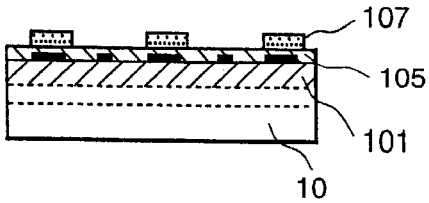
Figure 8E:
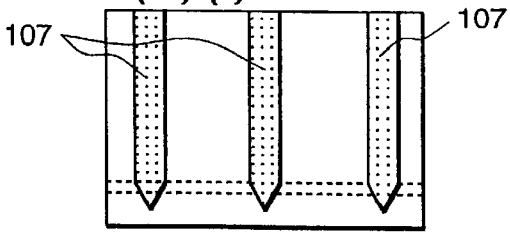
Figure 9A:
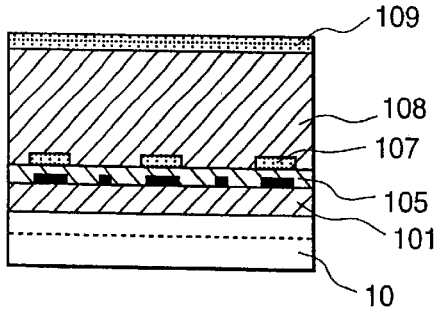
FIGS. 9(*a*) to 9(*d*) are section views which illustrate further successive steps of the method of manufacturing the ink discharge portion according to the present invention, and FIGS. 9(*a*)(1) to 9(*d*)(1) are top plan views of the structures illustrated in FIGS. 9(*a*) to 9(*d*), respectively.
Figure 9A:
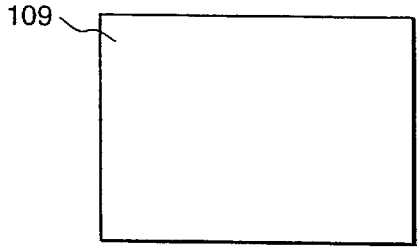
Figure 9B:
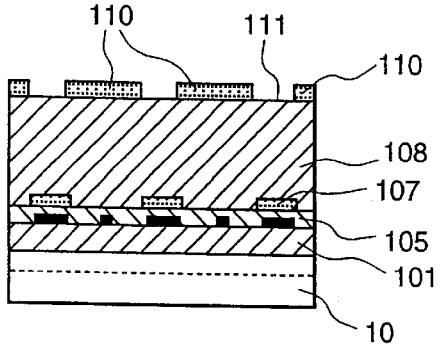
Figure 9B:
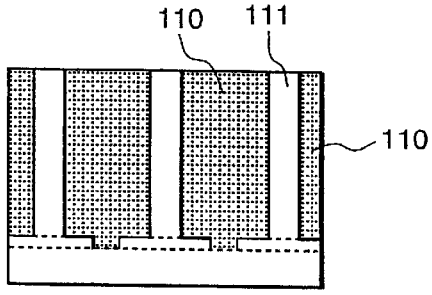
Figure 9C:
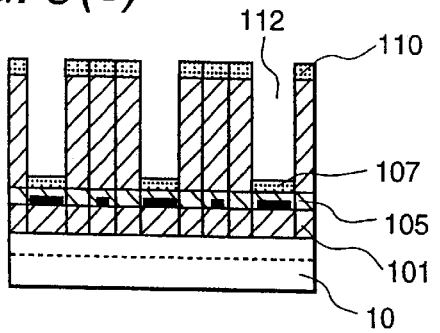
Figure 9C:
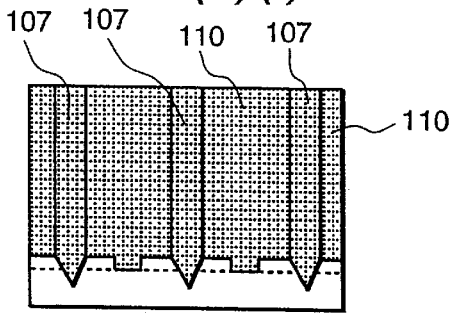
Figure 9D:
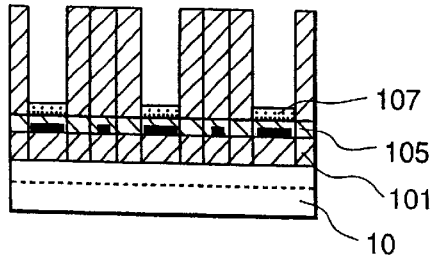
Figure 9D:
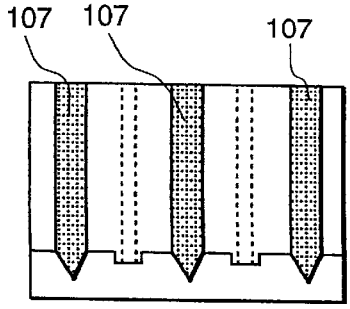
Figure 10A:
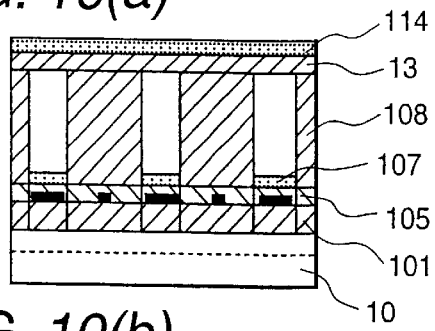
FIGS. 10(*a*) to 10(*e*) are section views which illustrate further successive steps of the method of manufacturing the ink discharge portion according to the present invention, and FIGS. 10(*a*)(1) to 10(*e*)(1) are top plan views of the structures illustrated in FIGS. 10(*a*) to 10(*e*), respectively.
Figure 10A:
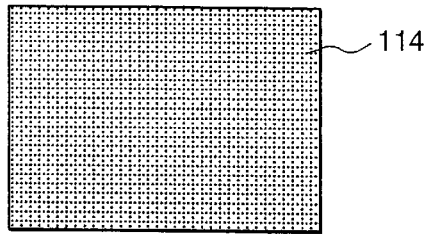
Figure 10B:
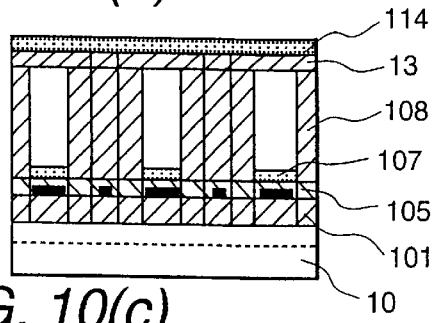
Figure 10B:
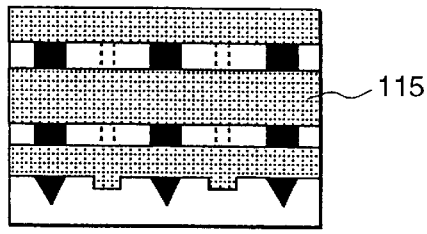
Figure 10C:
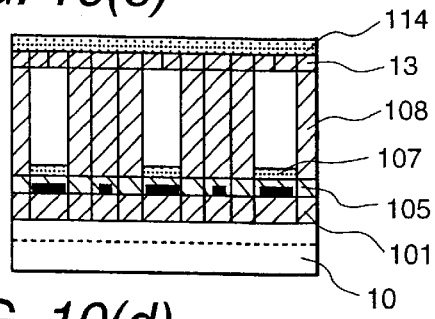
Figure 10C:
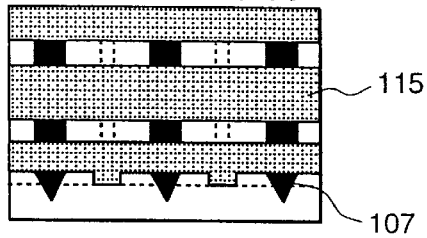
Figure 10D:
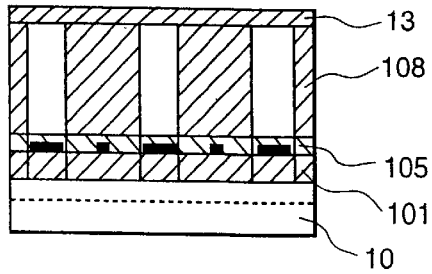
Figure 10D:
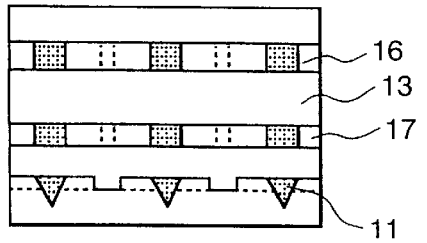
Figure 10E:
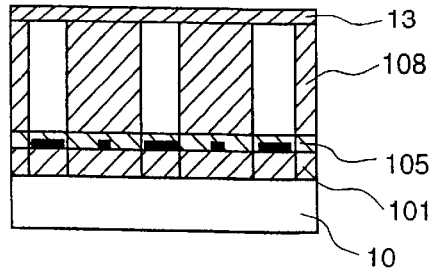
Figure 10E:
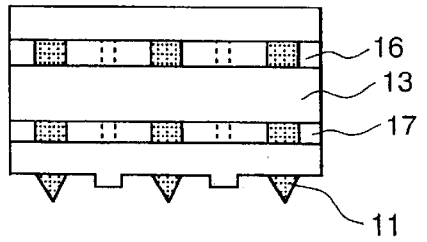

Further, a proper range (corresponding to the thickness of dielectric substance sheet 108) exists in the height of the ink channel in FIG. 1(*a*). About 70–150 μm is preferable for this height. The reason for this is that enough ink cannot be supplied to the point of the recording electrode 11 due to an increase in the ink channel resistance when the height of the ink channel is too low. On the contrary, the point of recording electrode 11 shifts downward due to the weight of the ink when the ink channel is too high, so that the impact position of the ink on the recording medium is displaced. Thus, it is possible to prevent the potential of each recording electrode 11 from being transmitted to the adjacent recording electrode 11 through the ink by individually providing an ink channel for every recording electrode. Therefore, the electric field distribution of each channel can be stabilized. However, because an ink meniscus is formed at the point of the recording electrode 11, as shown in FIG. 13, the ink meniscus is mechanically partitioned by a projecting part of the control electrode 12. And, because the electrode bias is applied to control electrode 12, the voltage applied to recording electrode 11 will never be transmitted to the adjacent recording electrodes. Control electrode 12 exists without touching the ink directly under the dielectric substance sheet 108, as shown in FIG. 1(*b*). Further, instead of the method of collecting ink from the point of a recording electrode 11, as shown in FIG. 1, it is possible to collect ink in a direction downward from the point of recording electrode 11, as shown in FIG. 7. In that case, it is not required to provide ink exit 17 at the upside insulating member 13 in the ink discharge part. Details of the configuration by which ink is collected downward will be explained with reference to FIG. 14. If the amount of the projection of the recording electrode 11 is set within the above-mentioned range, it is possible to select the directions from the horizon to the right above and from the horizon to the diagonal bottom, because ink is collected by using a pump, though the recording head of the present invention is one for recording while circulating ink. Because the interval of the recording electrode 11 becomes about 250 μm when the ink discharge part shown in FIG. 1–FIG. 3 is adopted, it is necessary to arrange recording electrodes 11 in a staggered form by stacking several substrates 10 to achieve a recording head which records a high definition image at a high speed.

Figure 11:
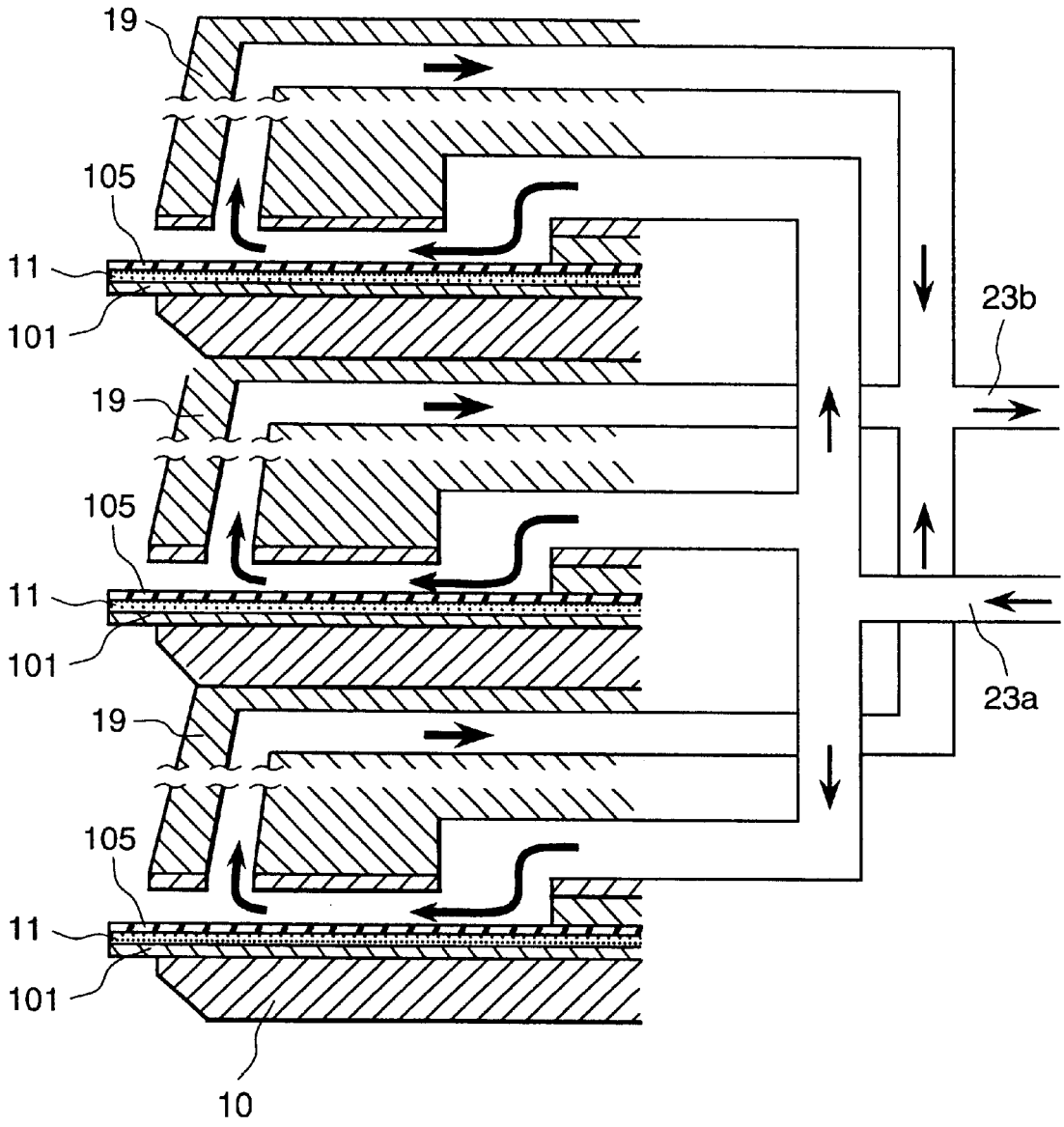
FIG. 11 is a sectional view of the configuration of the ink discharge portion of the present invention.

FIG. 11 shows a section through three substrates 10 piled up in a stack. In the ink jet recorder of the type where the recording head is fixed, the stage number n of a necessary substrate 10 is provided by a desired dot interval d1 when printing and the interval d2 of recording electrode 11 which exists on one substrate. Where, d2=d1×n.

The line heads of n stages are piled up so that ink discharge part 5 can be arranged to shift in a zigzag manner in order that a dot will be printed at a desired pitch in both the recording medium transportation direction and the vertical direction. Because, in the ink jet recorder of the type in which printing it carried out as the recording head is moving, the recorder with larger stage number n has an improved the printing speed and definition, so that the stage number n is based on the specification of the recorder.

One example of the method of manufacturing the above-mentioned ink discharge portion will be explained next with reference to FIG. 8(*a*)–FIG. 10(*e*), which show crosssections of the recording electrode as seen from the point side. FIGS. 8(*a*)(1) respectively shows a top view thereof.

As seen in 8(*a*), first of all, groove 100 is formed in substrate 10, such as a glass substrate of about 1 mm in thickness by using a dicing saw. The width L2 of this groove 100 is 0.2–0.5 mm, and the depth L1 is about 0.2 mm. However, it is necessary to increase the length L3more than the width, when it is used as a recording head.

As seen in FIG. 8(*b*), a dielectric polyimide sheet 101 of about 20 μm thick is provided on substrate 10 by thermocompression bonding, and a metallic film 102 about 1 μm thick is formed by a sputtering method, etc.

As seen in FIG. 8(*c*), a photoresist is spread on the metallic film 102, and the photoresist layer is exposed through a photomask which has a fixed electrode pattern. And, the photoresist pattern is formed on metallic film 102 by development. The recording electrodes 11 and control electrodes 12 are formed from the etching of a metallic film 102 by using this photoresist pattern as a mask.

As seen in FIG. 8(*d*), polyimide 105, which forms an insulation protection film, is spread by spin coating and is solidified. As a result, a film having a thickness of 5 μm level is formed. In addition, a metallic film 106 about 1 μm thick is formed thereon by a sputtering technique etc.

As seen in FIG. 8(*e*), a photoresist is spread on metallic film 106, and the photoresist layer is exposed through a photomask which has a fixed electrode pattern. And, the photoresist pattern is formed on metallic film 106 by development. A desired electrode pattern 107 is formed from the etching of metallic film 106 by using this photoresist pattern as a mask. This electrode pattern 107 is wider by about 5 μm than the pattern of the recording electrodes 11.

As seen in FIG. 9(*a*), a dielectric polyimide sheet 108 about 70–100 μm thick is formed on the electrode pattern 107 by thermocompression bonding. In addition, metal film 109 about 2 μm thick is formed on that. A different metallic film from metallic film 106 is used as metallic film 109. The reason for this is that selection etching is needed in the post-processing of this method of manufacture.

As seen in FIG. 9(*b*), a metallic film pattern 110 and the metal-dissolved space 111 are formed next by using photolithography and etching like the above-mentioned process.

As seen in FIG. 9(*c*), space 112 which serves as an ink channel is formed by dry-etching the polyimide layer 108 by using metallic pattern 110,107 as a mask, and the point protruding portions of the recording electrodes 11 and control electrodes 12 are formed at the same time.

As seen in FIG. 9(*d*), only metallic pattern 110 is removed by a wet etching.

As seen in FIG. 10(*a*), polyimide sheet 13 about 20 μm thick is formed on polyimide layer 108 by thermocompression bonding, and a metallic film 114 about 1 μm thick is formed on that. Here, the same material as used metallic film 107 may be used as metallic film 114.

As seen in FIG. 10(*b*)(1), a metallic film pattern 115 is formed by photo lithography and etching similar to the above-mentioned process.

As seen in FIG. 10(*c*)(1), polyimide sheet 13 is processed by dry etching using this metallic film pattern 115 as a mask.

As seen in FIG. 10(*d*)(1), metallic films 107 and 114 are removed by wet etching, and an ink entrance 16 and an exit 17 are formed. Exit 17 is unnecessary for the method of ink circulation shown in FIG. 7.

As seen in FIG. 10(*e*)(1), the groove is formed from the back using a dicing saw according to groove 100 on the surface of substrate 10. And, substrate 10 is folded and divided at the bottom in two grooves and the folded surface is ground diagonally.

The points of recording electrodes 11 and the points of control electrodes 12 project suitably from the edge of the substrate 10 as a result of the above-mentioned process. Finally, cover 19 in which an ink channel is formed in the upper part of manufactured substrate 10 is provided. As a result, the ink discharge portion of FIG. 1 is completed.

Between at least adjacent and above-and-below substrates, when the ink discharge portion of FIG. 11 is manufactured, substrates 10 having a cover 19 are accumulated, with the position of the recording electrodes 11 being displaced in an inplane direction.

Figure 14:
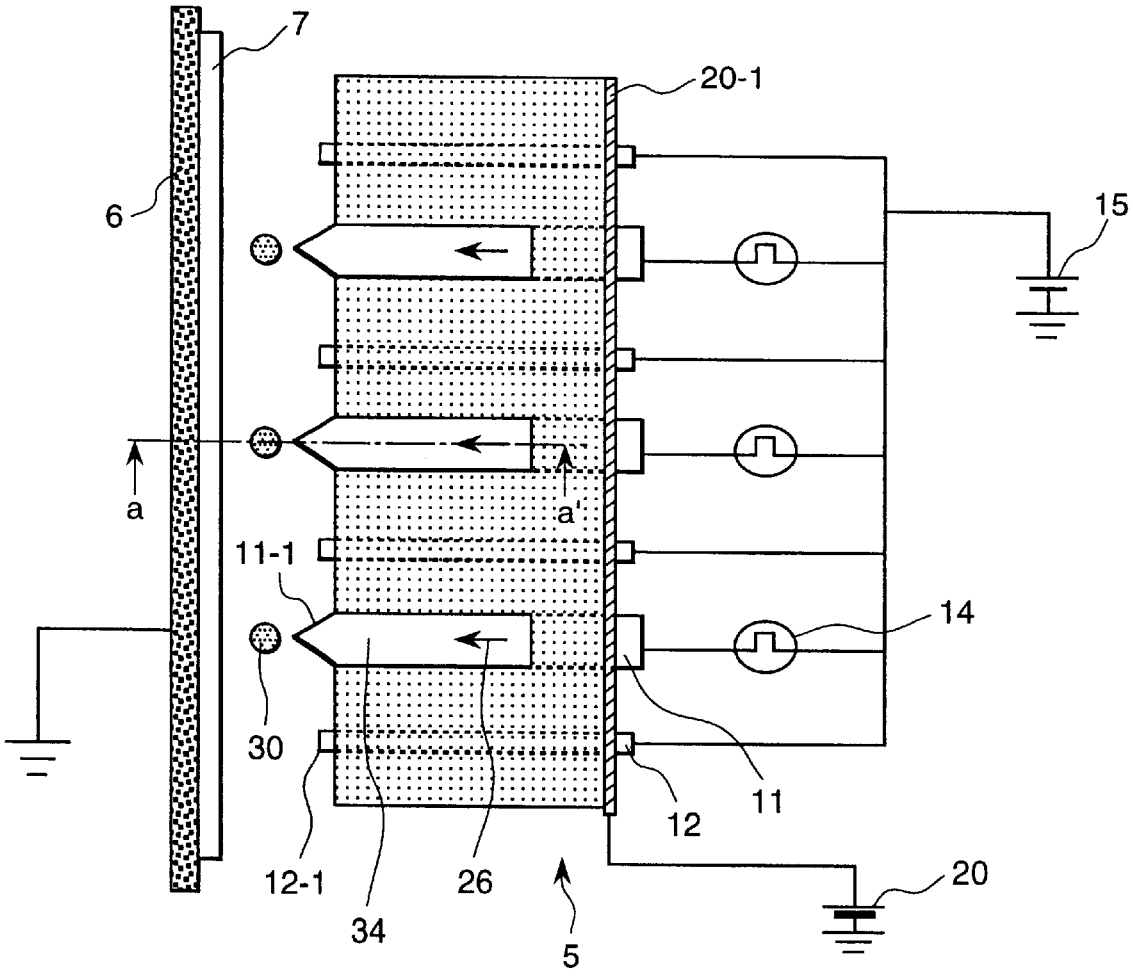
FIG. 14 is a cross-sectional view showing another embodiment of the ink discharge portion of the ink jet recording head according to the present invention.
Figure 15:
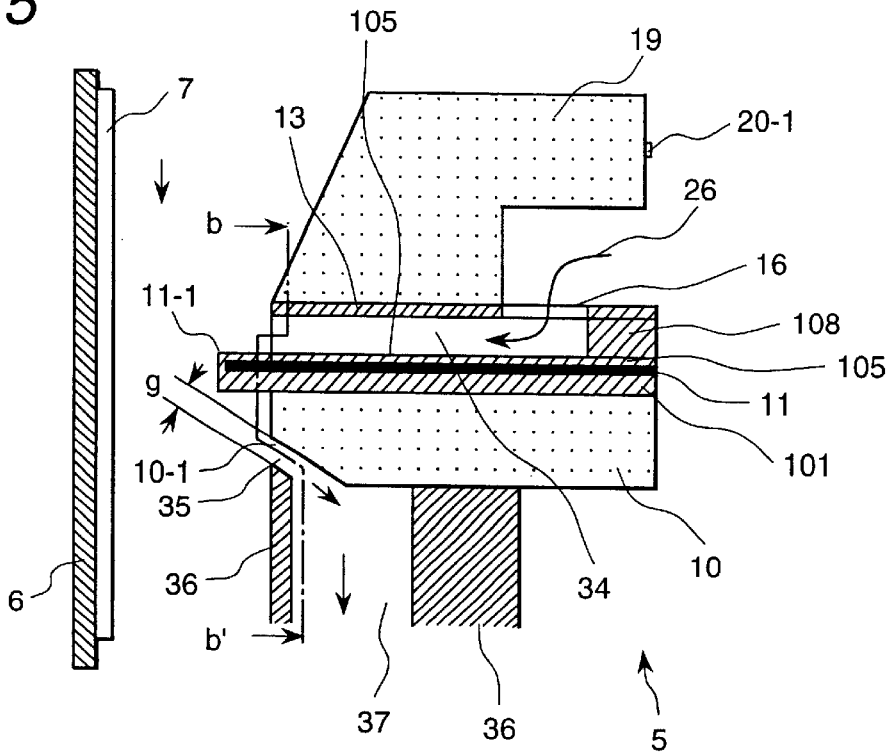
FIG. 15 is a sectional view taken along the line a–a' in FIG. 14.
Figure 16:
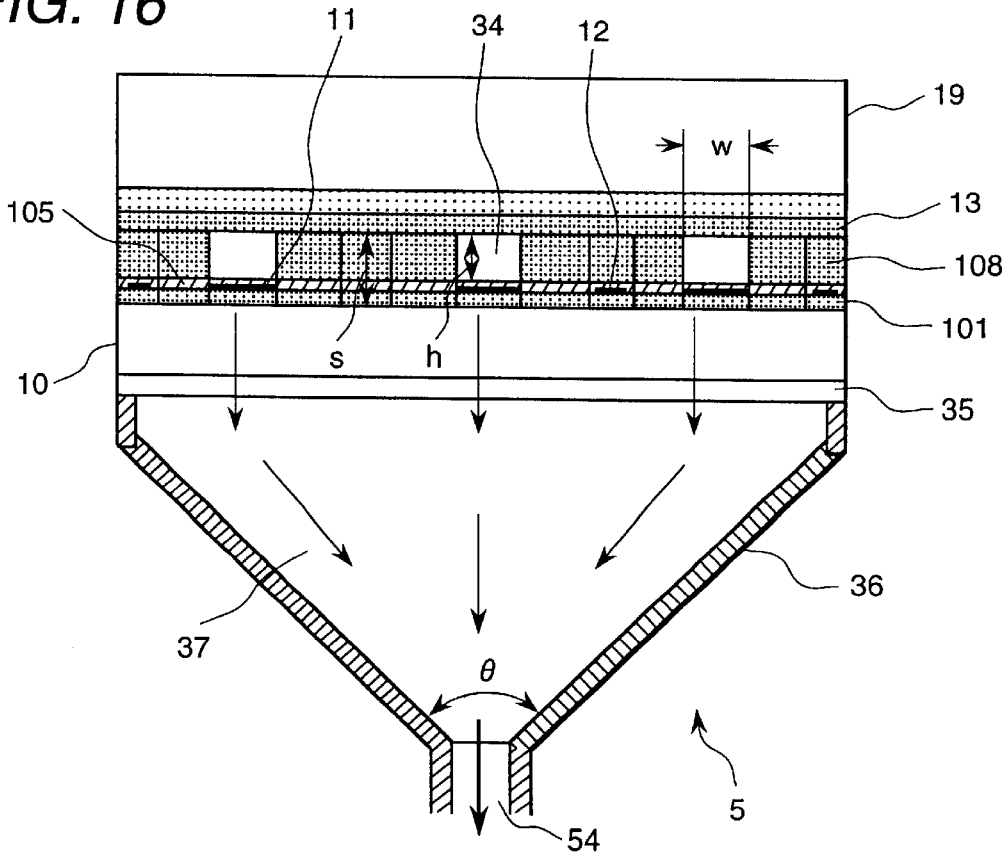
FIG. 16 is a sectional view taken along the line b–b' in FIG. 15.

FIG. 14, FIG. 15, and FIG. 16 show the configuration in which ink is collected from the points of recording electrodes 11 shown in FIG. 7 downward. These figures are the schematic diagrams of the ink discharge portion of the ink jet recorder according to another embodiment of the present invention. FIG. 14 shows an upper sectional view of the ink discharge portion, FIG. 15 shows a section taken on line a–a' in FIG. 14, and FIG. 16 shows a section taken on line b–b' in FIG. 15.

Recording electrodes 11 and control electrodes 12 are formed by depositing a metallic film and wet-etching using photo lithography after the thermocompression-bonding of a resin film 101 (for instance, negative type exposure resin film) of a low dielectric substance (specific inductive capacity is 3 or less) on a glass substrate 10. Point portions 11-1 of the recording electrodes project from the end face of glass substrate 10 and have a sharp angle. Further, they are arranged in parallel at a constant interval as shown in FIG. 14. In addition, the recording electrodes 11 and control electrodes 12 are covered by an insulation protection film 105.

On the other hand, point portion 12-1 of the control electrode is behind point portion 11-1 of the recording electrode and projects from the end face of glass substrate 10. Each control electrode 12 is arranged between recording electrodes 11 at a constant interval.

In addition, a migration electrode 20-1, which has the same length as the width of a row of recording electrodes 11 or more, is arranged at the rear on the opposite side with respect point portions 11-1 of the recording electrodes, and it is right-angled with respect to the direction of recording electrodes 11. Migration power supply 20 is connected to said migration electrode 20-1. There is an effect in that the amount in which the particles of electrification pigments included in ink gather toward points 11-1 of the recording electrodes is increased by raising the voltage applied from migration power supply 20 to a level higher than the electrode bias applied from bias supply 15. However, migration electrode 20-1 is not necessarily used for this purpose. When the printing speed is increased, and the particles of electrification pigments supplied to point portion 11-1 of the recording electrode is increased, this electrode is effective.

Point portion 12-1 of the control electrode serves to separate the ink meniscus between adjacent recording electrodes 11 mechanically by being covered with a low dielectric resin film 101 on an insulation protection film 105 and projecting. In addition, high resolution picture printing with few differences in the size of the flight of the ink drop and the bending of the flight of the ink drop due to the influence between adjacent recording electrodes 11 is made possible by intercepting the interference due to the electric field between adjacent recording electrodes 11. It is preferable to set the height s of the point of the control electrode to the same height h as an ink channel or more, in order to make the effect by which the ink meniscus between adjacent recording electrodes 11 is mechanically separated more effective.

The point of the metallic control electrode is covered by a layer which is configured of a resin of a dielectric substance in the portion where it projects from the end face of the glass substrate 10. Of course, a similar effect can be obtained even if a similar shape is configured only of the metallic control electrode.

Ink supply channel 34 in the ink discharge portion 5 is formed, along the upper side of recording electrode 11, by working resin film 108 (for instance, a negative type photosensitive resin film) of a low dielectric substance thermocompression-bonded on insulation protection film 105 by a wet etching using lithography, as shown in FIG. 15 and FIG. 16. Ink supply channel 34 in the recording head is worked deeper, with a high degree of accuracy and in a short time, by adopting the wet etching processing method compared with the above-mentioned dry etching processing method.

Next, resin film 13 formed of a low dielectric substance (for instance, negative type resist resin film) is put on ink supply channel 34, said dielectric substance resin film 108 is thermocompression bonded to seal the ink supply channel 34, and then ink supply port 16 is processed by wet etching. In addition, cover 19 is bonded on low dielectric resin film 13. As a result, supplying ink 26 to ink supply channel 34 becomes possible.

As shown in FIG. 14, ink supply channel 34 is formed along recording electrode 11, ink 26 is supplied in the direction designated by the arrow, and said supply ink flows toward point the portion 11-1 of the recording electrode.

FIG. 14 and FIG. 16 each shows the configuration in which three recording electrodes 11 and four control electrodes 12 are illustrated as a matter of convenience. However, the number of these recording electrodes 11 and control electrodes 12 can be increased from dozens to several thousands according to the usage of the ink jet recorder in a similar manner, by alternately arranging recording electrodes 11 and control electrodes 12 and providing control electrodes 12 at both ends of the recording head. Therefore, it is needless to say that it is possible to produce a multi-channel type recording head and a line type recording head.

Here, an electrode bias is applied from bias supply 15 to each recording electrode 11, and the pulse voltage from the pulse voltage generation circuit 14 is superimposed on the bias voltage applied to recording electrode 11 to make the ink fly. In addition, ink 26 is made by distributing a coloring material or pigments in a solvent of the petroleum oil group, such as isoparafin, or a solvent of silicon group, with a dispersing agent and an electrification control agent, etc., and making positive-electrified pigment particles. Additionally, the detailed content of the ink is as explained with reference to FIG. 4. Therefore, an electric field is formed between grounded common electrode 6, and recording medium 7 disposed on said common electrode 6, and point portion 11-1 of said recording electrodes by applying the electrode bias from bias supply 15 in FIG. 14, whereby positively electrified pigment particles are collected point 11-1 of the recording electrode, where they are concentrated. Then, concentrated ink drop 30 is allowed to fly toward recording medium 7 by applying a pulse voltage from the pulse voltage generation circuit 14. Migration electrode 20-1 is provided on cover 19, which consists of a dielectric substance, in the rear of the recording electrode as shown in FIG. 15. Here, when the weight ratio of the insoluble material which contains pigments included in said ink drop is more than the weight ratio of the solvent, a stable discharge of ink drops becomes difficult as the period of the application of the pulse voltage is increased from about 1 kHz to about 10 kHz, in addition to the effects described with reference to in FIG. 1. Therefore, it is preferable that the weight ratio of said insoluble material included in ink drops is less than that of the solvent.

Next, the configuration by which the residual ink quantity is determined after the ink is collected will be explained with reference to FIG. 15 and FIG. 16. Minute space 35 with a constant size g is provided between ink collection member 36 and point portion 10-1 of the glass substrate having a slope near the point of the recording electrode. In addition, an airflow is applied to ink collection member 36 and ink collection channel 37, formed by the portion of glass substrate 10 which has a slope, in order to collect said residual ink quantity under point 11-1 of the recording electrode and at a certain angle which intersects the direction of point 11-1 of the recording electrode. The residual ink quantity mixes with the above-mentioned airflow and is collected at high speed. Therefore, by collecting the air around ink meniscus formed around the recording electrode and the control electrode and drawing it into the ink collection channel through a minute space, an airflow is generated around the ink meniscus, and thus a suitable ink meniscus for ink discharge is formed. Especially, the range of 100 $\mu$m–500 $\mu$m was found to be effective as the size g of the channel of said minute space 35. The shape of the ink meniscus 18 in FIG. 17 and FIG. 18, to be described later, did not form an ideal concave in 500 $\mu$m or more, and in 100 $\mu$m or less, and the shape of above-mentioned ink meniscus 18 was not steady.

Here, the pressure of point portion 11-1 of each of the plurality of recording electrodes (negative pressure) and the amount of ink collection can be evened up by widening the shape of the ink collection member 36 at the point portion 11-1 side of the plurality of recording electrodes, and narrowing it as it becomes further from the points of the recording electrodes, as shown in FIG. 16. The effective angle θ was found to be from 30 to 120°. The size of the ink collection member 36 was large compared with the length of the recording head (length of the direction of a row of said recording electrodes) at 30° or less, and said pressure (negative pressure) and the amount of ink collection was not able to be evened up at 120° or more.

Figure 17:
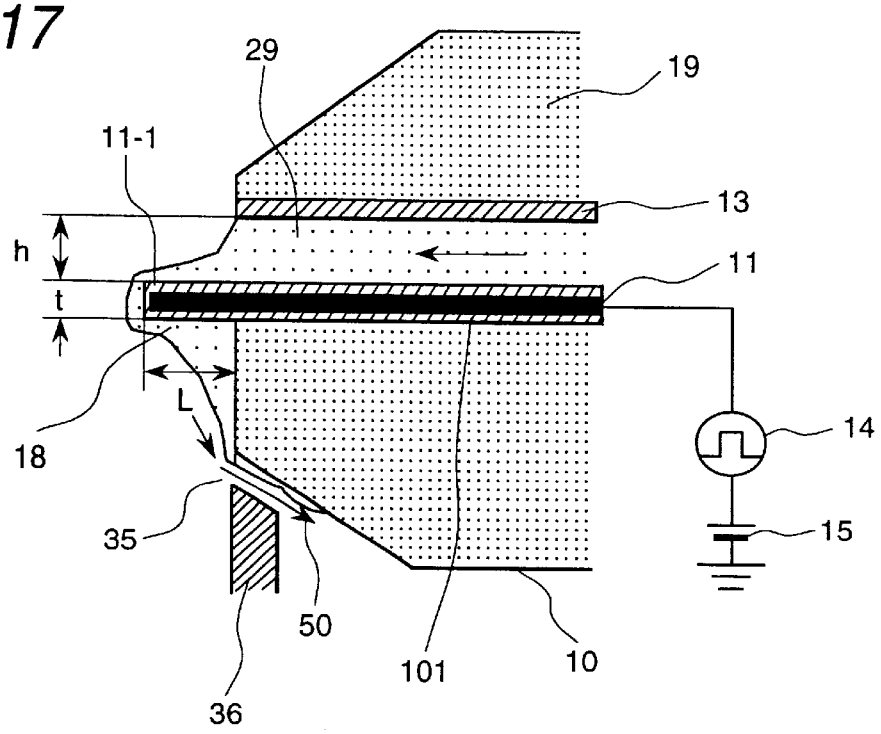
FIG. 17 is a diagram showing the ink meniscus formed near the recording electrode in the ink discharge portion of FIG. 15.
Figure 18:
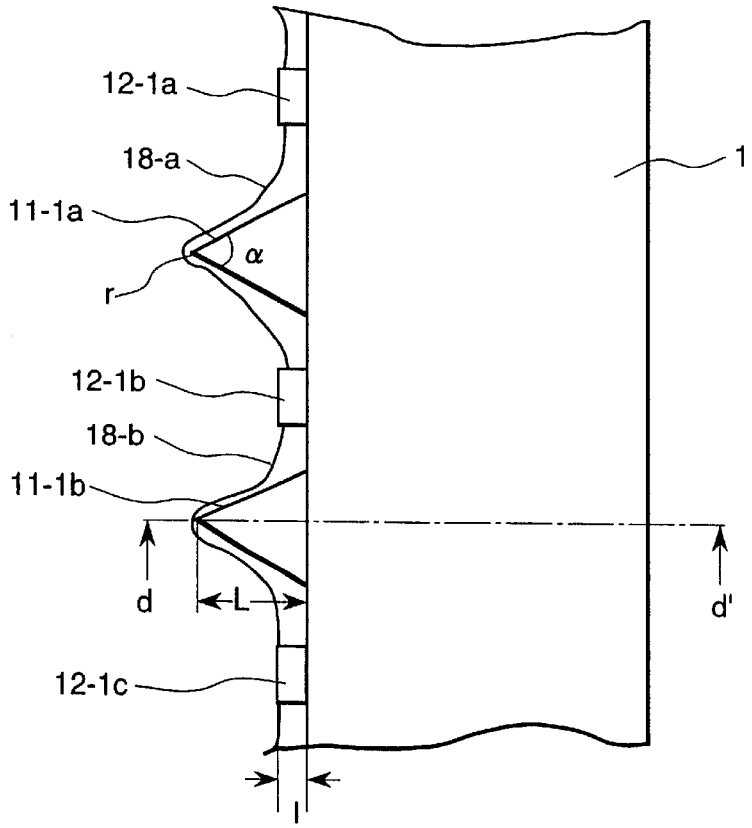
FIG. 18 is a diagram showing the ink meniscus formed near the recording electrode in the ink discharge portion of FIG. 14.

The pigments included in said ink can be prevented from adhering by installing a film (not shown) of ink material in the ink collection channel 37 of the ink collection member 36 and in the minute space 35 as seen in FIG. 15 and FIG. 16. In addition, it is possible to obtain a configuration in which the variation per hour of the ink meniscus 18 shown in FIG. 17 and FIG. 18 is small, and the ink circulation system is stable.

It is needless to say that a similar effect can be obtained even if the point portion 11-1 side of plural recording electrodes is widened, and the collection ink outflow entrance 54 side is formed so as to have a narrow curved surface, though the shape of the ink collection member 36 is shown to have a V-letter form in FIG. 16.

Figure 19:
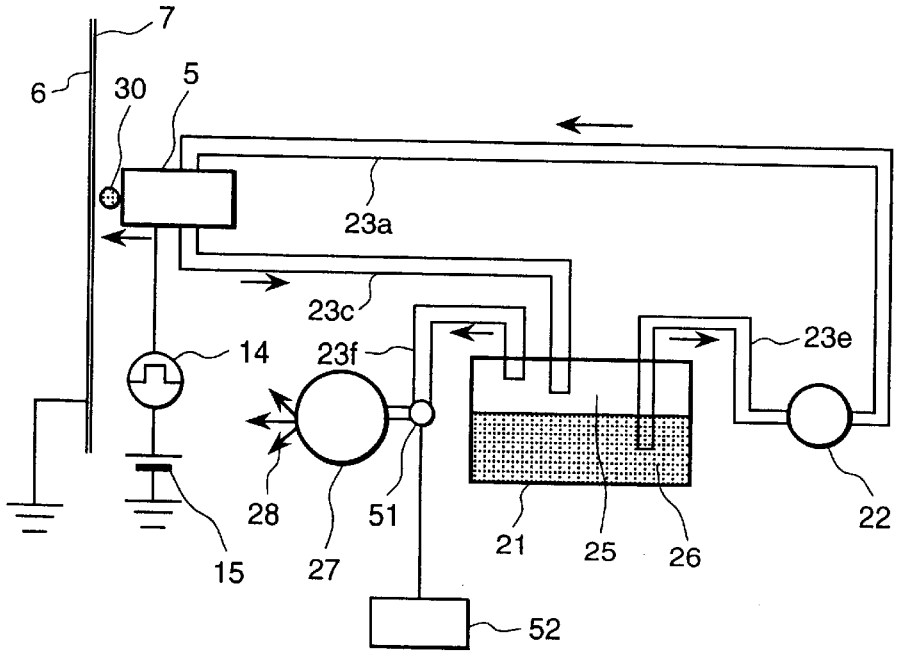
FIG. 19 is a schematic diagram showing another embodiment of the ink jet recording head according to the present invention.

FIG. 19 is a schematic diagram of the recording head, which includes the ink circulation portion of the ink jet recorder according to one embodiment of the present invention. Here, the example of the ink discharge portion 5 is the same as the embodiment of FIG. 14, FIG. 15, and FIG. 16. Common electrode 6 is opposed to the ink discharge portion 5, and the recording medium 7 is in contact with common electrode 6 as shown in FIG. 19. In addition, ink 26 is supplied to ink discharge portion 5 via ink supply pipe 23*e* and 23*a* by pump 22, and ink is collected via ink collection tube 23*c*. The common electrode 6 is grounded, and an electrode bias of about 0.5 kV–3 kV is applied to ink discharge portion 5 by bias supply 15. In addition, a pulse voltage of about 0.2 kV–1 kV is superimposed on the electrode bias applied to the electrode by pulse voltage generation circuit 14 according to the record signal. An ink drop 30 is caused to fly from the point of ink discharge portion 5 toward recording medium 7 due to the electrostatic field formed between the ink discharge portion 5 and common electrode 6, with which the recording medium 7 is in contact. High resolution picture recording becomes possible because the size of the ink drop 30 can be freely changed in proportion to the pulse width of the pulse voltage 14.

The minute particles of positively electrified pigment are collected along point 11-1 of the recording electrode, by distributing the pigments in a solvent of a petroleum oil group, such as isoparafin, or a solvent of a silicon group, with a dispersing agent and an electrification control agent, to produce positive-electrified minute particles, which are concentrated. Therefore, the concentration of ink drop 30 is improved more than pigment concentrations of ink supplied from the ink supply pipe 23*a*. A blur of ink on the recording medium 7, which occurs in the conventional ink jet recorder can be reduced, and it becomes possible to obtain a high resolution picture. In addition, the recording medium which can be used is not limited, so that convenience and low-cost use become possible.

It is necessary to make the amount of ink 26 supplied to the ink discharge portion 5 and its supply pressure (positive pressure), and the amount of ink 26 collected from the ink discharge portion and its collection pressures (negative pressure) constant, and it is necessary to circulate ink at high speed in order to fly a stable ink drop 30 at high frequency in the ink jet recording method which has such various features. To keep the amount of the ink supplied to the ink discharge portion 5 and its supply pressure (positive pressure) constant, the amount of ink supply and the supply pressure of pump 22 should be kept constant. It is necessary to enlarge the sectional area of ink supply channel (34 in above-mentioned FIG. 15) in ink discharge portion 5 to make ink circulate at high speed.

Next, air is sucked by a suction mechanism (by using suction tube 23*f* and vacuum pump 27 in this embodiment) which sucks air from air layer 25 in the ink collection container 21, which is sealed up, and discharges it into the atmosphere as exhaust 28 to keep the amount of the ink 26 collected from the ink discharge portion 5 and its collection pressure (negative pressure) constant. The space occupied by air layer 25 is at a negative pressure because ink collection container 21 is a sealed structure. Surplus ink is collected from the point of ink discharge portion 5 to ink collection container 21 with air via piping 23*c*, which communicates with the space containing air layer 25 of negative pressure. The mixture of air and surplus ink collected in the air layer 25 in ink collection container 21 is separated by the specific gravity difference between the air and ink in the air layer 25. The separated ink merges into collected ink 26, and air is discharged into atmosphere by vacuum pump 27 as exhaust 28 via suction tube 23*f*. The amount of the collection of ink 26 collected from ink discharge portion 5 and its collection pressure (negative pressure) can be kept constant by setting the suction force of said vacuum pump 27.

The pressure of air layer 25 can be changed and the shape of the ink meniscus shown in FIG. 17 and FIG. 18 can be controlled by controlling the airflow control valve 51 according to an instruction from a flow control circuit 52, thereby adjusting the amount of the airflow which flows in suction tube 23*f* and the flow velocity. Ink 26 in ink collection container 21 is drawn up by pump 22 via piping 23*e*, and it is supplied to ink discharge portion 5 via piping 23*a*.

Figure 20:
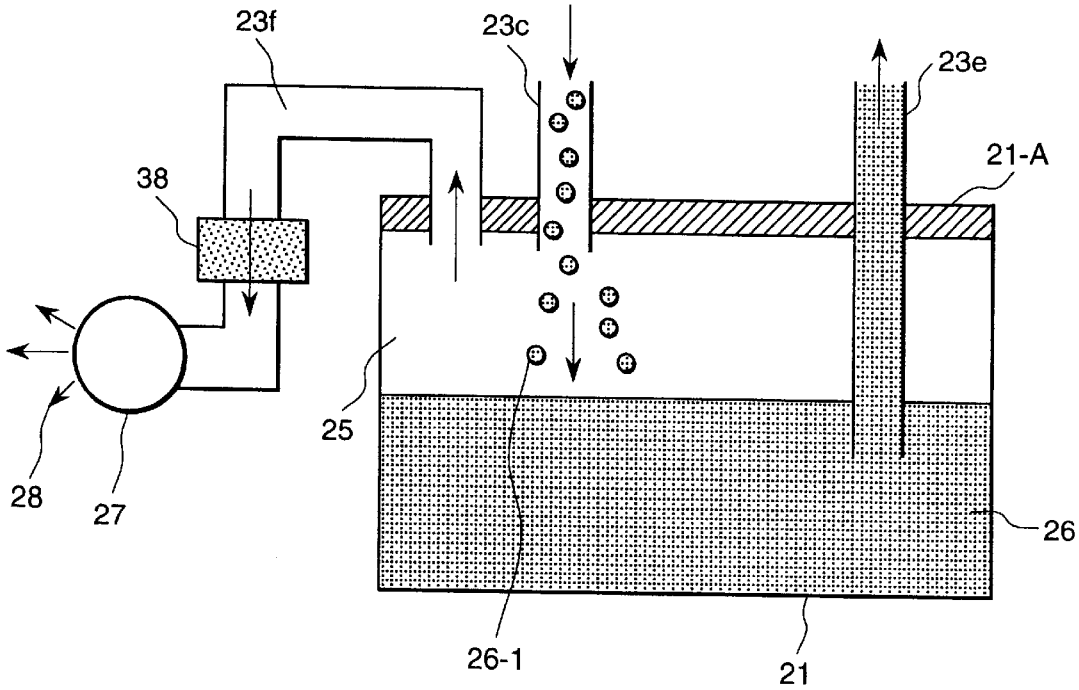
FIG. 20 is a diagram showing an enlarged view of a part of FIG. 19.

Details of the separation of ink and air in the ink collection container 21 in FIG. 19 is shown in FIG. 20. The inside of said ink collection container 21 is sealed by container lid 21-A. Further, the ink collection container 21 has a two layer structure. Collection ink layer 26, where the specific gravity is high, is formed in the lower part of the container. Further, an air layer 25, where the specific gravity is low, is formed in the upper part above the collection ink layer 26. Air is sucked from the air layer 25 by vacuum pump 27 through air suction tube 23*f* inserted in air layer 25, and sucked air 28 is exhausted to the atmosphere. As a result, air layer 25 is decompressed to a negative pressure, and the mixture of the air and the surplus ink is sucked from piping 23*c* into the air layer 25 in the ink collection container 21. Ink particles 26-1 having a high specific gravity drop due to the difference in the specific gravity after the mixture is sucked into air layer 25, and these ink particles are absorbed into the ink layer 26. Air with low specific gravity stays in the air layer 25, and it is exhausted to the atmosphere by vacuum pump 27 through air suction tube 23*f*. As a result, the pressure of the air layer 25 (negative pressure) is always kept constant. It is possible to exhaust clean air to the atmosphere by using a filter 38. Ink is drawn up by piping 23*e* inserted in the collection ink layer 26.

Figure 21:
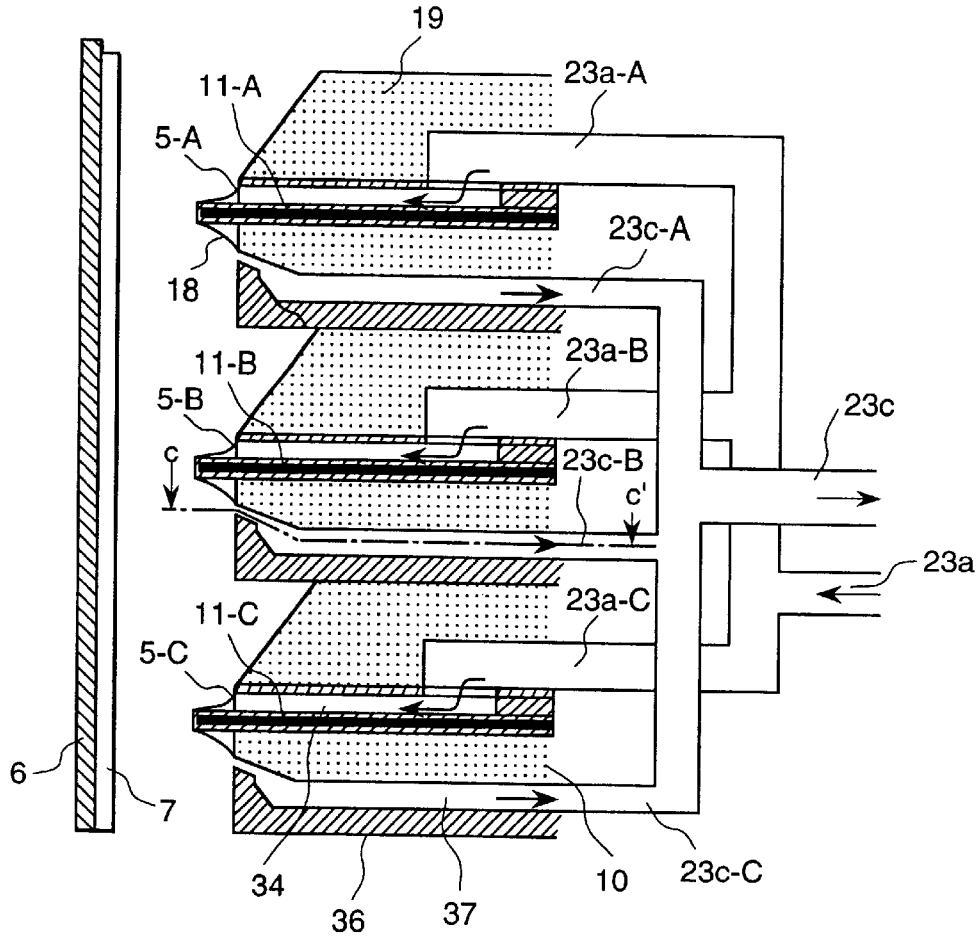
FIG. 21 is a sectional view of another embodiment of the ink discharge portion in the ink jet recording head according to the present invention.
Figure 22:
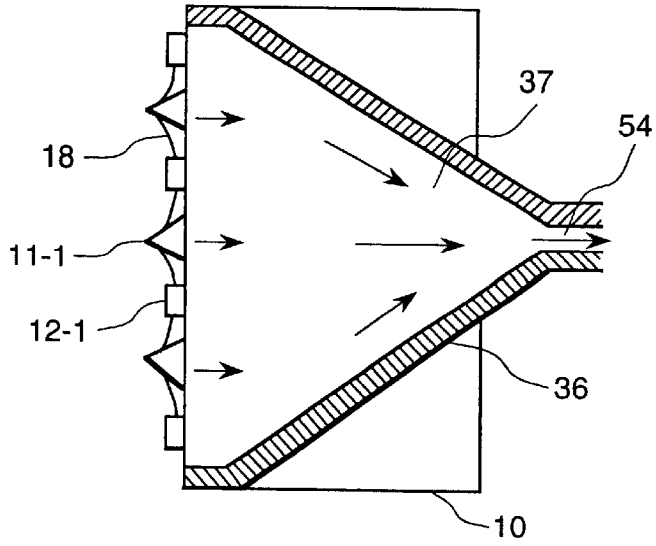
FIG. 22 is a sectional view taken along the line c–c' in FIG. 21.

FIG. 21 and FIG. 22 show an embodiment of an ink discharge portion in the ink jet recorder of the present invention, wherein a plurality of ink discharge parts are stacked is piled. FIG. 22 shows a section taken along line c–c' in FIG. 21.

By changing only the ink collection member 36 in the ink discharge portion 5 in the embodiment based on FIG. 14 to FIG. 16, and by forming an ink collection channel 37 along the glass substrate 10, as shown in FIG. 21 and FIG. 22, ink discharge portion 5-A, ink discharge portion 5-B, and ink discharge portion 5-c are stacked and fixed. In this case, it is important that the position of point 11-1 of each of the recording electrodes 11-A, 11-B, and 11-C in each ink discharge portion is adjusted with a high degree of accuracy.

It is necessary to form a position adjustment mark or position adjustment projection and a position adjustment hole (not shown) the ink discharge parts 5-A, 5-B, and 5-C in the process of forming a thin film therein, in order to minimize the difference in parallelism in top and bottom and right and left directions, and the pitch drift of recording electrodes 11-A, 11-B, and 11-C between ink discharge parts, and make the interval of common electrode 6, recording medium 7, and the point 11-1 of said each recording electrode uniform. Ink is supplied to individual ink supply pipes 23*a*-A, 23*a*-B, and 23*a*-C of the recording head that is stacked with a high degree of accuracy through ink supply pipe 23*a*.

Further, ink is collected from individual ink collection tubes 23*c*-A, 23*c*-B, and 23*c*-C through ink collection tube 23*c*. Ink flows from the individual ink supply pipe toward point portion 11-1 of the recording electrode in the ink supply channel 34 via cover 19 by such a configuration, and an ink meniscus 18 is formed between point portion 11-1 of said recording electrode and point portion 12-1 of said control electrode. The unused ink is collected from collection ink outflow entrance 54 to the individual ink collection tube via an ink collection passage. This configuration has the same feature as that in the embodiment of FIG. 14 to FIG. 16. In addition, an ink drop can fly from the recording electrodes 11-A, 11-B, and 11-C toward common electrode 6 and recording medium 7 at the same time. Therefore, making an ink dot of high density, whereby high-speed printing becomes possible.

Figure 23:
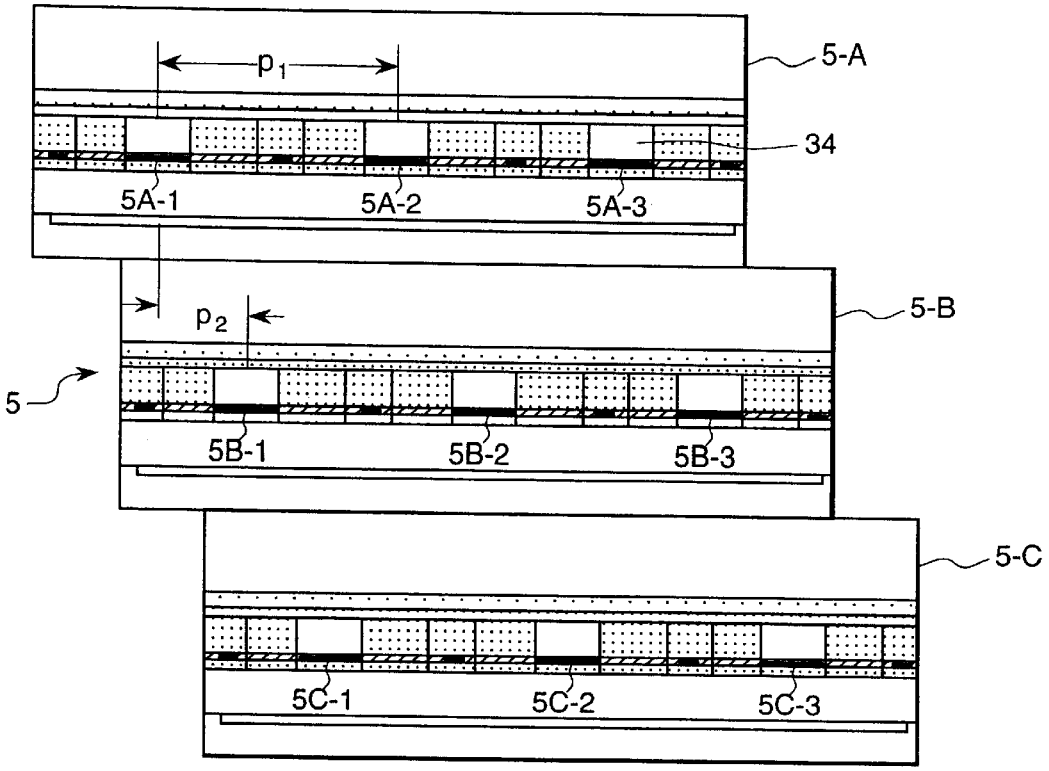
FIG. 23 is a left side view of ink discharge portion in FIG. 21.

The left side view of the ink discharge part of FIG. 21 is shown in FIG. 23. The pitch between recording electrode 5A-1, 5A-2, and 5A-3 of single ink discharge part A is P1. However, by shifting the positions of the three ink discharge parts 5-A, 5-B, and 5-C and stacking them in a staggered fashion, that is, by adding recording electrodes 5B-1, 5B-2, 5B-3 of ink discharge portion 5-B and recording electrodes 5C-1, 5C-2,5C-3 of ink discharge portion 5-C, the pitch P2 between the recording electrodes is made one third.

It is necessary to increase the width of the ink supply channel 34 in the ink discharge portion 5 to secure a sufficient amount of ink circulation. Making the desired ink dot high density can be achieved by stacking a plurality of ink discharge portions as shown in FIG. 23, although there is a limitation in narrowing the pitch P1 between recording electrodes in a single ink discharge portion.

It is needless to say that it is possible to increase and decrease the number of ink discharge portions to be stacked, if necessary, although the provision of three ink discharge portions is shown in this embodiment.

Further, the control of each ink supply and the collection becomes easy, and the arrangement of parts in the ink jet recording head becomes easy by sharing the supply and the collection of ink in the stacked ink discharge portions for the multi-steps in the root of a ink discharge portion.

An example in which the positions of plural ink discharge portions 5-A, 5-B, and 5-C are shifted and stacked in a staggered fashion is shown in FIG. 21 and FIG. 23. However, it is possible to print at high speed compared with the case of single record head by piling ink discharge portions without shifting them and circulating ink.

Details of the effect obtained by making the pressure of the air layer 25 (negative pressure) in the ink collection container 21 shown in FIG. 20 constant will be explained with reference to FIG. 17 and FIG. 18.

FIG. 18 shows a partial enlarged side view of the ink discharge portion 5, and FIG. 17 shows a section taken along the line d–d' in FIG. 18.

Constant airflow 50 is generated in the direction designated by the arrow through minute space 35 formed by glass substrate 10 and collection member 36 according to the constant pressure of the air layer 25 shown in FIG. 19 (negative pressure), and the residual ink is collected with the airflow 50. It is possible to adjust the speed of the airflow and the flow amount by increasing and decreasing the negative pressure of air layer 25 shown in FIG. 19, and it is possible to optimize the shape of the ink meniscus 18, which encompasses the point portion 11-1 of the recording electrode 11, so that it is concave along the front end part of the glass substrate 10, as shown in FIG. 17. Here, it is important to keep the ink meniscus steady at the time the ink flies. The airflow is controlled by a vacuum pump to stabilize ink meniscus.

Ink meniscus 18-*a* and 18-*b*, seen from the upper surface of the recording head in FIG. 18, can be also formed uniformly to have a concave shape along the front end of the glass substrate 10 to encompass point portions 11-1*a* and 11-1*b* of the recording electrodes. Further, the ink meniscus 18-*a* and 18-*b* are interrupted mechanically by point portions 12-1*a*, 12-1*b*, and 12-1*c* of the control electrodes. Here, it is to be understood that the angle $\alpha$ of the point of said recording electrode greatly influences the ink flight. When the angle $\alpha$ exceeds 70°, ink flight becomes difficult due to a decrease in the concentration of the electric field at the point of the recording electrode. When the angle a becomes smaller than 25°, the agglutination of the pigment particles in the ink is strengthened too much at the point of the recording electrode, and the ink flight becomes difficult, although the concentration of the electric field at the point of the recording electrode is improved. Therefore, it is preferable that the angle $\alpha$ is within the following ranges.

$$25° \leqq \alpha \leqq 70°$$

Next, it has been determined that the ratio of the thickness t of the point to curvature r of the point of said recording electrode greatly influences the ink flight. For example, the concentration of the electric field on the point of the recording electrode decreases, the ink flight becomes difficult and the shape of the ink drop becomes an oval when enlarging t/r, that is, when the point thickness t is increased, the point curvature r is reduced, and t/r exceeds 6.0. On the other hand, the machine strength of the recording electrode decreases as the point thickness t is reduced when reducing t/r, that is, when the point thickness t is reduced and the point curvature r is enlarged. Therefore, when the point is transformed by external force due to the high-speed flow of ink and the point curvature r is enlarged, the concentration of the electric field on the point of the recording electrode is decreased, and stable ink flight becomes difficult, when t/r is 1.0 or less.

As a result, it is preferable that the ratio of point thickness t and point curvature r satisfies the following relationship.

$$1.0 \leqq t/r \leqq 6.0$$

Next, it has been determined that the ratio of the height h of ink channel and the projection amount 1 of the control electrode is important for a stable ink drop flight. When the mechanical shield effect on the ink meniscus by the point of the control electrode becomes insufficient, the movement of ink to the adjacent recording electrode side will occur easily, and a stable ink flight becomes difficult, when enlarging h/1, that is, when the height h of the ink channel is increased and the projection amount 1 of the recording electrode is reduced. On the other hand, when reducing h/1, that is, when the height h of the ink channel is lowered, and the projection amount 1 of the control electrode is enlarged, the ink was not supplied easily to the point of the recording electrode, the concentration of the electric field on the point of the recording electrode was decreased, and a stable ink flight became difficult.

Therefore, it is preferable that h/1 satisfies the following relationship.

$$5 \leqq h/1 \leqq 8.0$$

Next, it has been determined that the ratio of the height h of the ink channel and the width w of the ink channel, as shown in FIG. 16, is important for proper ink flight. When enlarging h/w, that is, when the height of the ink channel is enlarged, the width of the ink channel is reduced, and h/w exceeded 2.0, the manufacture of the channel was difficult. When reducing h/w, that is, when the height of the ink channel is reduced, the width of the ink channel is enlarged, and h/w falls below 0.5, the supply of ink to the point of the recording electrode was difficult, and stable ink flight was difficult.

Therefore, it is preferable that h/w satisfies the following relationship.

$$0.5 \leqq h/w \leqq 2.0$$

Next, it has been determined that the ratio of projection amount 1 of the point of said control electrode and the projection amount L of the point of said recording electrode is important for a stable ink flight. When enlarging 1/L, that is, when the projection amount 1 of the control electrode was enlarged, the projection amount L of the recording electrode was reduced, and 1/L became more than 0.4, ink discharge became difficult due to the decrease of the concentration of the electric field on the point of the recording electrode. When reducing 1/L, that is, when the projection amount 1 of the control electrode was reduced, the projection amount L of the recording electrode was enlarged, and 1/L became smaller than 0.1, the mechanical interruption of said ink meniscus by the control electrode point became insufficient, ink got over the point of said control electrode and flowed out to the point of the adjacent recording electrode, and stable ink discharge became difficult.

Therefore, it is preferable that the relation of the amount L of the projection of the point of the recording electrode to the projection amount 1 of said control electrode point is as follows.

$$0.1 \leqq 1/L \leqq 0.4$$

The concentration of the electrostatic field formed according to the discharge electrode point form and ink meniscus form becomes strong by optimizing the ink meniscus form. As a result, ink can fly stably toward the common electrode 6 and recording medium 7 even if the electrode bias and the pulse voltage are lowered. Especially, the economical effect is remarkable because the pulse voltage generated by pulse voltage generation circuit 14 can be lowered, so that low voltage drive becomes possible, and the adoption of a general-purpose driving IC becomes possible.

In addition, the size of the ink drops can be equalized by keeping the shape of the ink meniscus of each discharge electrode point constant, and the possibility of producing a high resolution picture is also extremely large.

Figure 24:
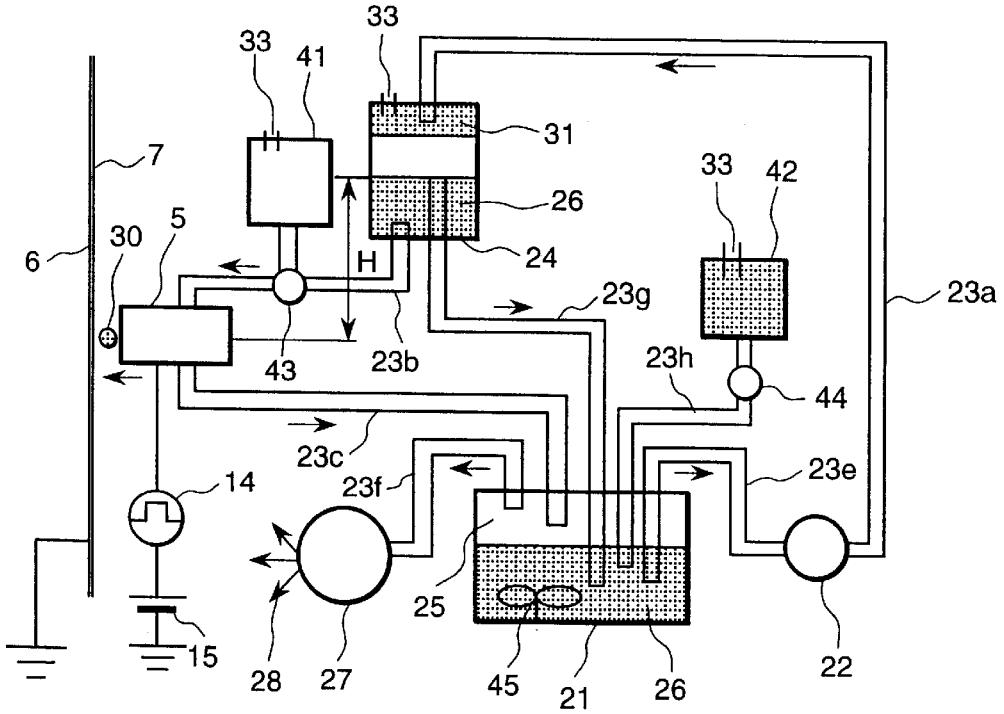
FIG. 24 is a schematic diagram of another embodiment of the ink discharge portion in the ink jet recording head according to the present invention.

FIG. 24 is a schematic diagram of the ink jet recording head which includes the ink circulation part according to one embodiment of the present invention, in which the function is added to the configuration of the embodiment in FIG. 19. Common electrode 6, which is opposed to the ink discharge portion 5 and is in contact with recording medium 7, is arranged as shown in FIG. 24. In this embodiment, ink 26 is supplied to ink discharge portion 5 via ink supply passage 23*b*, and ink 26 is collected via ink collection passage 23*c*.

To keep the ink supply and the ink supply pressure (positive pressure) constant, the liquid level of ink 26 in ink flow modulating compartment 24 and the head H of the recording head should be kept constant. Therefore, an overflow ink collection passage 23*g* is provided between ink flow modulating compartment 24 and ink collection container 21, and ink within a range which exceeds the top of overflow ink collection passage 23*g* is collected in ink collection container 21. As a result, the head H can be kept substantially constant anytime. Thus, the configuration shown in FIG. 5 may be used for keeping the head H constant. It is necessary not only to raise the head H, but also to enlarge the sectional area of the ink supply passage in the ink discharge portion 5 to circulate ink at high-speed. However, it is possible to make the ink circulate at high speed by using the ink discharge portion shown in the above-mentioned FIG. 14, FIG. 15, and FIG. 16.

Next, air in the ink collection container 21 is sucked by vacuum pump 27 through air suction tube 23*f* and is discharged into the atmosphere as exhaust 28 to keep the amount of ink and the collection pressure (negative pressure) in container 21 constant. Air layer 25 becomes a negative pressure in the ink collection container 21, which is a sealed structure. Surplus ink is collected in the ink collection container 21 via ink collection passage 23*c* which extends into air layer 25 of negative pressure. The amount of ink and its collection pressure (negative pressure) can be kept constant by setting the suction of vacuum pump 27.

Collection ink 26 in ink collection container 21 is drawn up by liquid pump 22 via ink supply pipe 23*e*, and it is dispensed into filter 31 via ink supply pipe 23*a*. Any foreign bodies in the ink 26 are filtered by filter 31 and collected in the ink modulating flow compartment 24.

In addition, ink and solvent switching valve 43 is provided in the ink supply pipe 23*b* to switch to either the supply of ink 26 in the ink modulating flow compartment 24 or the supply of solvent in the solvent supply container 41. Ink 26 in the ink modulating flow compartment 24 is supplied to the ink discharge portion 5 to provide the ink which forms the concentrated ink drop 30 when an image is printed. When image printing stops, the solvent in the solvent supply container 41 can be supplied, whereby the ink passages of the ink discharge portion 5, the ink supply pipe 23*b*, and the ink collection tube 23*c* are cleaned. As a result, in the ink circulation part the amount of ink circulation is prevented from changing due to pigments in the ink clinging in the ink passage, so that a high reliability can be obtained. It is possible to maintain the pigment concentration of the ink in the ink collection container within a fixed range by opening the concentrated ink supply valve 44 and supplying concentrated ink in the ink replenishment container 42 to the ink collection container 21. To prevent ink pigments from settling and to maintain the ink uniformity, a stir mechanism 45 is provided in the ink collection container 21. In addition, to subject the ink to atmospheric pressure, that is, to the solvent, air vent 33 is provided in the upper part of ink modulating flow compartment 24, ink replenishment container 42 and solvent supply container 41.

It is preferable that ink replenishment container 42 and solvent supply container 41 are cartridges that are able to be detached.

Figure 25:
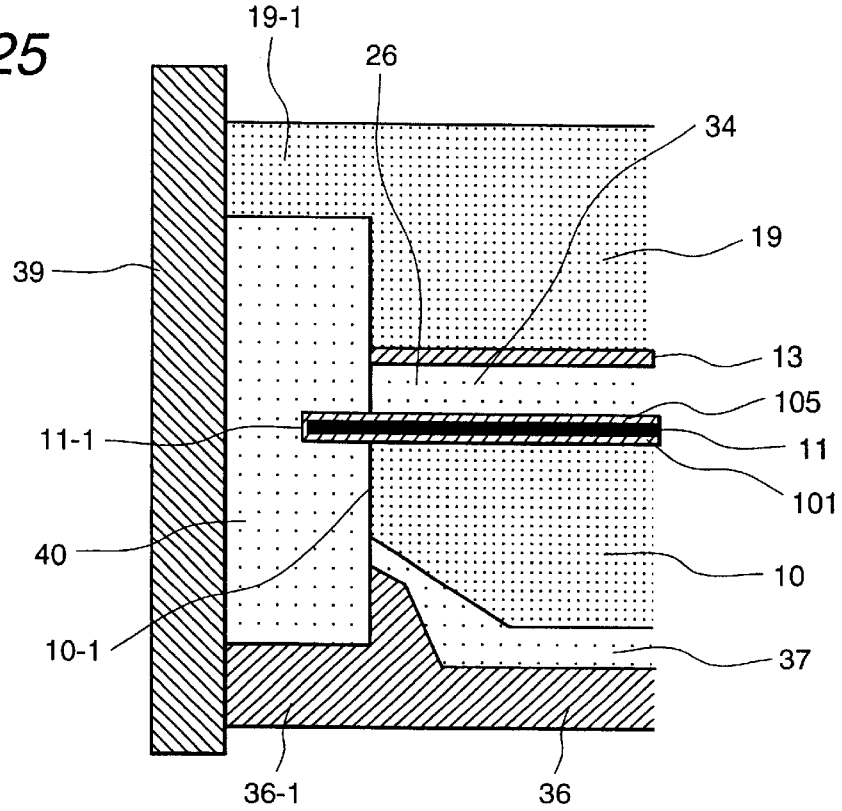
FIG. 25 is a sectional view of another embodiment of the ink discharge portion in ink jet recording head according to the present invention.

An embodiment which is directed to the protection of the point of the recording electrode according to the present invention is shown in FIG. 25. Protection protruding portion 36-1 on ink collection member 36 and protection protruding portion 19-1 on the cover 19 project from point 10-1 of the glass substrate. By increasing the height of the projection of said protruding portion so that it extends further than point 11-1 (dielectric substance resin film 101 and insulation protection film 105 are included) of the recording electrode, protection protruding portions 36-1 and 19-1 can support the recording medium when recording medium 7 approaches point 11-1 of the recording electrode at the time of image recording. As a result, recording medium can be prevented from coming into contact and damaging point 11-1 of the recording electrode.

In addition, ink pocket 40, which encompasses point 11-1 of the recording electrode, is formed by protection protruding portion 36-1, protection protruding portion 19-1, and glass substrate point 10-1. Ink pocket 40, which encompasses point 11-1 of the recording electrode, is sealed by bumping capping material 39 against said protection protruding portions when image recording stops so as to stop the collection of ink from ink collection channel 37. On the other hand, ink supply channel 34 supplies ink 26 to ink pocket 40 to fill it with ink. As a result, the ink on point 11-1 of the recording electrode is prevented from drying. Accordingly, changes in the ink drop discharged from the point of said recording electrode due to pigment particles included in the ink being stuck to point 11-1 of the recording electrode can be reduced, so that an image recorder in which the reliability is extremely high can be obtained. It is more effective when a soft elastic body (not shown) is provided to seal up the part of the capping material 39 that contacts said protection protruding portion 36-1, 19-1, so as to prevent ink leakage, or when the capping material 39 is formed with a soft elastic body.

Figure 26:
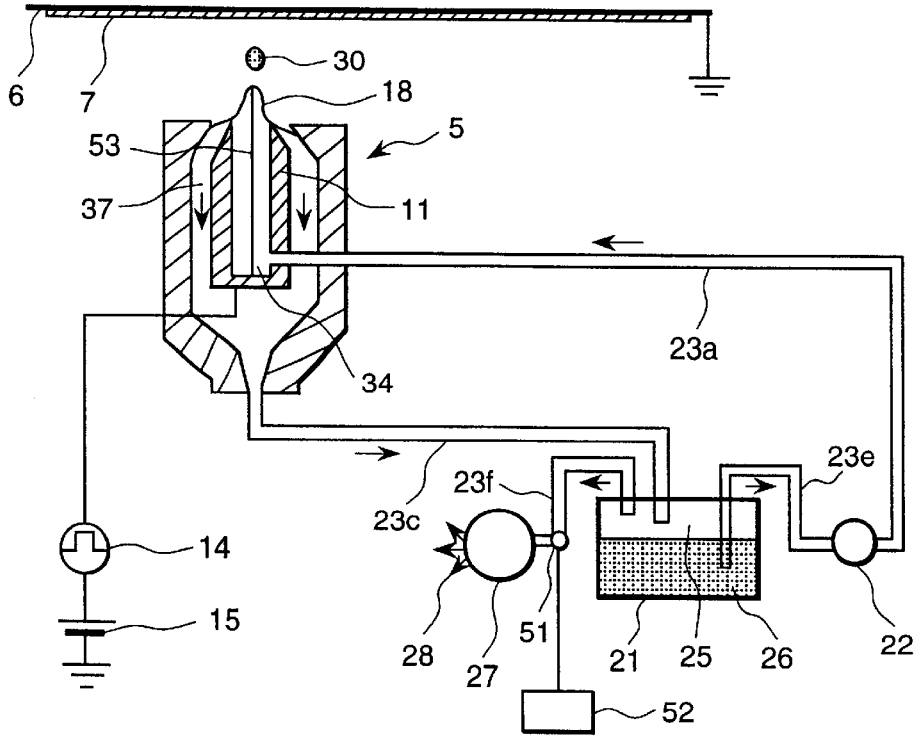
FIG. 26 is a schematic diagram showing another embodiment of the ink jet recording head according to the present invention.

Another embodiment of the ink jet recording head according to the present invention, having an ink discharge portion that is different from that of FIG. 19, is shown in FIG. 26.

Ink discharge portion 5 forms an ink meniscus 18 by using a configuration in which a plurality of recording electrodes 11 are arranged on both sides of a projecting board 53, which has a plurality of sharp points made of a dielectric substance, an ink supply pipe 23*a* is connected to an ink supply channel 34 which is sandwiched by projecting board 53 and recording electrode 11, and ink is supplied to the point of the recording electrode 11 and the point of the projecting board 53. An ink drop 30 is discharged from the point of projecting board 53 toward common electrode 6 and recording medium 7 by applying a pulse voltage from the pulse voltage control circuit 14 and an electrode bias from bias supply 15 to recording electrode 11. The remaining ink is collected in the direction designated by the arrows with the airflow produced by the negative pressure of air layer 25 in ink collection container 21 by connecting collection tube 23*c* to ink collection channel 37. Air suction tube 23*f* is inserted into the air layer 25, air is sucked by vacuum pump 27, and sucked air is exhausted to atmosphere as exhaust 28. The ink and the air which entered air layer 25 through ink collection tube 23*c* are separated in the air layer 25, and the separated ink enters the ink layer 26. Collected ink 26 is supplied to ink supply channel 34 by pump 22 through tube 23*e* and the tube 23*a*. The air flow rate and the flow velocity which flows in suction tube 23*f* can be adjusted by controlling the flow control valve 51 according to an instruction received from the flow control circuit 52. As a result, it is possible to control the ink meniscus 18 to have a shape suitable for the flight of the ink drop 30. In the ink jet recording head having the configuration of FIG. 26, the shape of ink meniscus 18 can be controlled by the airflow, so that the ink drop 30 can fly even if the pulse voltage applied by pulse voltage generation circuit 14 is reduced to a low voltage, whereby the ink drop 30 can be made uniform.

In addition, the ink circulation velocity of the ink discharge portion 5 can be increased because the air layer 25 is at a negative pressure and ink is collected compulsorily with the airflow, so that the ink can flow steadily even if the frequency of generation of the ink drops 30 is increased. As a result, the printing speed of the ink jet recorder can be made high-speed.

As described above, in the ink jet recording head according to the present invention, the impact position of ink at the time of printing can be prevented from shifting, so that an ink jet recording head which produces a high definition image can be provided.

Further, an ink jet recording head in which the shape of a lot of ink discharge parts can be easily arranged to form a line head is achieved, and a recording head that can be manufactured cheaply and easily can be provided.

Further, an ink jet recording head which can operate with a low drive voltage and make the amount of the ink flight uniform can be provided.

Further, a ink jet recording head which can print at high speed can be provided.

As mentioned above, an ink jet recording head or an ink jet recorder according to the present invention is useful for recording a highly accurate picture and the character, etc. by ink flight, and it is suitable for use in a color ink jet printer which records using various media.

What is claimed is:

1. An ink jet recording head comprising:

a substrate, a plurality of recording electrodes arranged on said substrate, a plurality of control electrodes arranged so as to sandwich each of said recording electrodes, an ink circulation part for supplying ink which contains coloring material in solvent to said recording electrodes to flow it in a direction of length of said each recording electrode, and collecting said ink from a point of said each recording electrode.

2. The ink jet recording head according to claim 1, wherein a shroud of a dielectric substance is provided between said each recording electrode and said each control electrode, and between said each control electrode and an ink channel.

3. The ink jet recording head according to claim 1, wherein said each recording electrode projects from the edge of said substrate.

4. The ink jet recording head according to claim 3, wherein said each control electrode project from the edge of said substrate, and the projection amount of said each control electrode is smaller than that of said each recording electrode.

5. The ink jet recording head according to any one of claims 1 to 4, wherein said each recording electrode is covered by the insulation coating material.

6. Ink jet recording head according to claim 1, wherein an angle θ of said ink collection channel is in the following ranges $$30° \leqq \theta \leqq 120°.$$

7. The ink jet recording head according to claim 1, wherein height s of the point of said control electrode is equal to or more than height h of the ink channel.

8. An ink jet recording head comprising:

a substrate, a plurality of recording electrodes arranged on said substrate, a plurality of control electrodes arranged so as to sandwich each of said recording electrodes, and an ink circulation part having ink supply channel provided to flow ink which contains coloring material in solvent to said recording electrodes in a direction of length of said each recording electrode, and ink collection channel for collecting the ink from a point of said each recording electrode that said ink is discharged to the lower side of said each recording electrode, wherein the shape of ink meniscus formed in the vicinity of the point of said each recording electrode is controlled by giving the airflow directly to said ink meniscus.

9. An ink jet recording head comprising:

a substrate, a plurality of recording electrodes arranged on said substrate, a plurality of control electrodes arranged so as to sandwich each of said recording electrodes, and an ink circulation part having ink supply channel provided to flow ink which contains coloring material in solvent to said recording electrodes in a direction of length of said each recording electrode, and ink collection channel for collecting the ink from a point of said each recording electrode that said ink is discharged to the lower side of said each recording electrode, wherein said ink collection channel passes air with ink which flows from the vicinity of the point of said each recording electrode.

10. The ink jet recording head according to claim 8 or 9, further comprising:

a migration electrode provided at a rear end where ink of said each recording electrode is supplied, for increasing an amount of said coloring material in ink collected in the point of said each recording electrode.

11. The ink jet recording head according to claim 8 or 9, wherein an angle α of the point of said each recording electrode is formed within the following ranges $$25 \leqq \alpha \leqq 70°.$$

12. The ink jet recording head according to claim 8 or 9, further comprising a plurality of ink discharge parts at least including said plural recording electrodes and said plural control electrodes, and wherein each of said plural ink discharge parts is arranged with being overlapped like a zigzag, and the ink supply and the ink collection for said plural recording electrode are shared.

13. The ink jet recording head according to claim 8 or 9, further comprising a capping member for covering said plural recording electrodes, and ink holder formed between said capping member and the point of said each recording electrode.

14. The ink jet recording head according to claim 8 or 9, further comprising an ink container connected with said ink collection channel, having an ink layer for the ink collected from said ink collection channel and an air layer for air, and wherein the ink is collected by decompressing the air layer in said ink container.

15. The ink jet recording head according to claim 14, further comprising a vacuum pump connected to said ink container, for decompressing said air layer.

16. The ink jet recording head according to claim 8 or 9, wherein said ink collection channel has a space on the side near the point of said each recording electrode, and narrows at a certain angle as it becomes far from the point of said each recording electrode.

17. The ink jet recording head according to claim 8 or 9, wherein a ratio of height h and width w of said ink supply channel satisfies the following relationship $$0.5 \leqq h/w \leqq 2.0.$$

18. The ink jet recording head according to claim 8 or 9, wherein a ratio of height h of said ink supply channel and projection amount 1 of said control electrode from said substrate satisfies the following relationship $$0.4 \leqq h/1 \leqq 1.0.$$

19. The ink jet recording head according to claim 8 or 9, wherein a ratio of point thickness t and point curvature r of said recording electrode satisfies the following relationship $$1.0 \leqq t/r \leqq 6.0.$$

20. The ink jet recording head according to claim 8 or 9, wherein a ratio of projection amount I of said control electrode from said substrate and projection amount L of said recording electrode from said substrate satisfies the following relationship $$0.1 \leqq I/L \leqq 0.4.$$

21. The ink jet recording head according to any one of claims 1, 8 and 9, wherein the electrical resistivity of said ink is $10^7$ Ω·cm or more, the surface tension 30 mN/m or less, the viscosity 1–10 mpa·s, the mean particle size of coloring material 50–500 nm, the surface density of charges of the coloring material 1–100 $\mu C/m^2$, and the content of coloring material particles 1–10 percent by weight.

22. The ink jet recording head according to claim 21, wherein pigments are used as the coloring material.

23. The ink jet recording head according to claim 21, wherein isopar is used as the solvent.

24. The ink jet recording head according to claim 21, wherein silicone oil is used as the solvent.

25. An ink jet recording head comprising:

a substrate, a plurality of recording electrodes arranged on said substrate, a plurality of control electrodes arranged so as to sandwich each of said recording electrodes, and an ink circulation part having ink supply channel provided to flow ink which contains coloring material in solvent to said recording electrodes in a direction of length of said each recording electrode, ink collection channel for collecting the ink from a point of said each recording electrode that said ink is discharged to the lower side of said each recording electrode, and ink flow modulating room for modulating an amount of the ink flow to said each recording electrode through said ink supply channel, and wherein said ink collection channel passes air with ink which flows from the vicinity of the point of said each recording electrode, and the ink from said ink flow modulating room to said plural recording electrodes is supplied according to a head difference by a position where said ink flow modulating room and said plural recording electrodes are arranged.

26. The ink jet recording head according to claim 25, further comprising an ink replenishment container connected with said ink container, for storing ink thicker than ink concentration in said ink container, and a concentration ink adjustment part for adjusting the supply of thick ink from said ink replenishment container to said ink container.

27. An ink jet recording head comprising:

a substrate, a plurality of recording electrodes arranged on said substrate, a plurality of control electrodes arranged so as to sandwich each of said recording electrodes, and an ink circulation part having ink supply channel provided to flow ink which contains coloring material in solvent to said recording electrodes in a direction of length of said each recording electrode, and ink collection channel for collecting the ink from a point of said each recording electrode that said ink is discharged to a lower side of said each recording electrode along a part of said substrate, wherein said ink collection channel has a space provided with respect to said substrate to flow the ink and the air collected from said each recording electrode, and said space g is within the following range $$100\ \mu m \leqq g \leqq 500\ \mu m.$$

28. An ink jet recording head comprising:

a plurality of recording electrodes arranged on a substrate, a plurality of control electrodes arranged so as to sandwich each of said recording electrodes, and an ink circulation part having ink supply channel provided to flow ink which contains coloring material in solvent to said recording electrodes in a direction of length of said each recording electrode, ink collection channel for collecting the ink from a point of said each recording electrode that said ink is discharged to a lower side of said each recording electrode, and ink flow modulating room for modulating an amount of the ink flow to said each recording electrode, and wherein a weight % of an insoluble material which includes the coloring material contained in an ink drop discharged from the point of said recording electrode is less than a weight % of the solvent.

29. An ink jet recording head comprising:

a plurality of recording electrodes arranged on a substrate, a plurality of control electrodes arranged so as to sandwich each of said recording electrodes, an ink circulation part having ink supply channel provided to flow ink which contains coloring material in solvent to said recording electrodes in a direction of length of said each recording electrode, ink collection channel for collecting the ink from a point of said each recording electrode that said ink is discharged to a lower side of said each recording electrode, and ink flow modulating room for modulating an amount of the ink flow to said each recording electrode, and a pulse voltage generation circuit for applying the pulse voltage to said plural recording electrodes, and wherein said substrate, said plural recording electrodes, said plural control electrodes, said pulse voltage generation circuit, and said ink circulation part are integrated together.

30. An ink jet recording head comprising:

a plurality of recording electrodes arranged on a substrate, a plurality of control electrodes arranged so as to sandwich each of said recording electrodes, an ink circulation part having ink supply channel provided to flow ink which contains coloring material in solvent to said recording electrodes in a direction of length of said each recording electrode, ink collection channel for collecting the ink from a point of said each recording electrode that said ink is discharged to a lower side of said each recording electrode, and ink flow modulating room for modulating an amount of the ink flow to said each recording electrode, a bias supply for applying an electrode bias to said plural recording electrodes and said plural control electrodes, a pulse voltage generation circuit connected to each of said plural recording electrodes, a recording medium carrying passage for carrying a recording medium, and a common electrode opposed to said plural recording electrodes.

31. An ink jet recording head comprising:

a substrate, a plurality of recording electrodes arranged on said substrate, a plurality of control electrodes arranged so as to sandwich each of said recording electrodes, an ink circulation part for supplying ink which contains coloring material in solvent to said recording electrodes to flow the ink in a direction of a length of respective ones of said recording electrodes and for collecting the ink from a tip of respective ones of the recording electrodes, said ink circulation part including ink channels provided for each recording electrode, the ink channels being at least partially delimited by shrouds.

32. The ink jet recording head according to claim 31, wherein the shrouds are shrouds of a dielectric substance.

* * * * *